US010701481B2

(12) United States Patent
Townsend et al.

(10) Patent No.: US 10,701,481 B2
(45) Date of Patent: Jun. 30, 2020

(54) MICROPHONE SOUND ISOLATION BAFFLE AND SYSTEM

(71) Applicant: Townsend Labs Inc., Campbell, CA (US)

(72) Inventors: Chris Townsend, Redwood City, CA (US); Heather Townsend, Redwood City, CA (US)

(73) Assignee: Townsend Labs Inc, Campbell, CA (US)

( * ) Notice: Subject to any disclaimer, the term of this patent is extended or adjusted under 35 U.S.C. 154(b) by 0 days.

(21) Appl. No.: 16/191,073

(22) Filed: Nov. 14, 2018

(65) Prior Publication Data

US 2020/0154201 A1 May 14, 2020

(51) Int. Cl.

*H04R 3/00* (2006.01)
*H04R 1/22* (2006.01)
*H04R 3/04* (2006.01)

(52) U.S. Cl.

CPC ..... *H04R 3/005* (2013.01); *H04R 1/222* (2013.01); *H04R 3/04* (2013.01); *H04R 2410/05* (2013.01)

(58) Field of Classification Search

CPC ..... H04R 3/005; H04R 1/222; H04R 3/04; H04R 2410/05; H04R 1/406; H04R 2201/403; H04R 1/20; H04R 2410/07

(Continued)

(56) References Cited

U.S. PATENT DOCUMENTS 1,682,409 A 8/1928 Nyman
1,700,553 A 1/1929 Swan (Continued)

FOREIGN PATENT DOCUMENTS

CN 103826174 A 5/2014
DE 4436272 A1 4/1996

(Continued)

OTHER PUBLICATIONS

Stedman Corporation Prosceen XL—Black, Sweetwater Sound, downloaded from the Internet from https://www.sweetwater.com/store/detail/StedmanXL-- stedman-corporation-proscreen-xl-black on Aug. 13, 2018.

(Continued)

*Primary Examiner* — Vivian C Chin
*Assistant Examiner* — Douglas J Suthers
(74) *Attorney, Agent, or Firm* — Stone Creek Services LLC; Alan M Flum

(57) ABSTRACT

A device, system, and method for modeling microphones and a microphone sound-isolation baffle that can be used with microphone modeling. The microphone modeling device, system, and method, can account for the effects of a microphone modeled with a microphone sound-isolation baffle and reduce unwanted audio coloration. The microphone model can work with single-capsule and dual-capsule microphones with the dual-capsule modeling able to achieve greater off-axis rejection and reduced off-axis coloration. The microphone modeling microphone sound-isolation baffle can attach to a specific reference microphone used for microphone modeling. The microphone sound-isolation baffle can be designed so the filter only attaches at a predetermined distance and at a predetermined rotational angle with respect to the microphone.

17 Claims, 26 Drawing Sheets

(58) Field of Classification Search
USPC ..... 381/91, 359, 360
See application file for complete search history.

(56) References Cited

U.S. PATENT DOCUMENTS

| | | | | |
|---|---|---|---|---|
| 2,049,586 | A | 8/1936 | Hanson et al. | |
| 2,065,456 | A | 12/1936 | Hayenga et al. | |
| 2,179,361 | A | 11/1939 | Braunmuhl et al. | |
| 2,263,408 | A | 11/1941 | Lakhovsky | |
| 2,325,424 | A | 7/1943 | Rettinger | |
| 2,627,932 | A | 2/1953 | Volkmann et al. | |
| 2,855,067 | A | 10/1958 | Di Mattia | |
| 3,154,171 | A | 10/1964 | Knutson et al. | |
| 3,881,056 | A | 4/1975 | Gibson et al. | |
| 3,895,188 | A | 7/1975 | Ingraham | |
| 4,042,779 | A | 8/1977 | Craven et al. | |
| 4,420,655 | A | 12/1983 | Suzuki | |
| 4,600,077 | A | 7/1986 | Dreyer | |
| 4,817,168 | A | 3/1989 | Fidi | |
| 4,888,807 | A | 12/1989 | Reichel | |
| 4,967,874 | A | 11/1990 | Scalli | |
| 5,193,117 | A | 3/1993 | Ono et al. | |
| 5,692,060 | A | 11/1997 | Wickstrom | |
| 5,781,643 | A | 7/1998 | Anderson | |
| 5,808,243 | A | 9/1998 | McCormick et al. | |
| 6,118,881 | A | 9/2000 | Quinlan et al. | |
| 6,584,736 | B2 | 7/2003 | Szymanski et al. | |
| 6,622,820 | B2 | 9/2003 | Pavlovic | |
| 6,810,125 | B2 | 10/2004 | Oster et al. | |
| 7,496,208 | B2 | 2/2009 | Uchimura | |
| 7,602,141 | B2 | 10/2009 | Kenoyer et al. | |
| 7,783,069 | B1 | 8/2010 | Miller et al. | |
| 7,970,151 | B2 | 6/2011 | Oxford et al. | |
| 8,191,678 | B2 | 6/2012 | Zou | |
| 8,208,673 | B2 | 6/2012 | Graham et al. | |
| 8,284,952 | B2 | 10/2012 | Reining et al. | |
| 8,666,090 | B1 * | 3/2014 | Townsend | H04R 3/005 381/92 |
| 8,737,662 | B2 | 5/2014 | Zukowski | |
| 8,873,762 | B2 | 10/2014 | Samsudin et al. | |
| 8,965,004 | B2 | 2/2015 | Scopece et al. | |
| 9,014,402 | B2 | 4/2015 | Terpstra et al. | |
| D733,690 | S | 7/2015 | Zukowski | |
| 9,118,989 | B2 | 8/2015 | Zukowski | |
| 9,173,046 | B2 | 10/2015 | Frey et al. | |
| 9,301,049 | B2 | 3/2016 | Elko et al. | |
| 9,560,433 | B2 | 1/2017 | Parker et al. | |
| 9,584,938 | B2 | 2/2017 | Chafe | |
| 9,838,769 | B2 | 12/2017 | Kauffman et al. | |
| D817,935 | S | 5/2018 | Zukowski | |
| 9,992,569 | B2 | 6/2018 | Terpstra | |
| 10,038,950 | B2 | 7/2018 | Avliav et al. | |
| 2003/0147540 | A1 * | 8/2003 | Oster | H04R 3/00 381/111 |
| 2006/0269089 | A1 | 11/2006 | Gieson | |
| 2010/0166215 | A1 | 7/2010 | Herman | |
| 2014/0064544 | A1 * | 3/2014 | Zukowski | H04R 1/083 381/360 |
| 2016/0360303 | A1 | 12/2016 | Armstrong | |

FOREIGN PATENT DOCUMENTS

| | | | |
|---|---|---|---|
| EP | 1152637 | A1 | 11/2001 |
| EP | 1737267 | B1 | 11/2007 |
| JP | 2006270903 | A | 10/2006 |
| JP | 2017160756 | A | 9/2017 |
| WO | 9949697 | A1 | 9/1999 |
| WO | 2017174624 | A1 | 10/2017 |

OTHER PUBLICATIONS

WindTech PopGard Microphone Windscreen, B&H Photo, downloaded from the Internet from https://www.phphotovideo.com/c/product/826109-REG/WindTech_POPGARD_PopGard_Microphone_Windscreen.html on Aug. 13, 2018.

On-Stage Stands ASVS6B Pop Blocker, Sweetwater Sound, downloaded from the Internet from https://www.sweetwater.com/store/detail/PopFilter6--on-stage- stands-asys6b-pop-blocker on Aug. 13, 2018.

Blue Microphones The Pop, Sweetwater Sound, downloaded from the Internet from https://www.sweetwater.com/store/detail/ThePop-blue-microphones-the-pop on Aug. 13, 2018.

Lewitt LCT 50 PSx Magnetic Pop Filter, Lewitt, downloaded from the Internet from https://www.lewitt-audio.com/products/accessories/lct-50-psx on Aug. 13, 2018.

The new Rode Al-1 Compete Studio Kit with Audio Interface, Rode, downloaded from the Internet from http://www.rode.com/ai1 on Aug. 13, 2018.

Kaotica Eyeball, Thomann, downloaded from the Internet from https://www.thomannmusic.com/kaotica_eyeball.htm on Aug. 13, 2018.

Primacoustic CrashGuard, Sweetwater Sound, downloaded from the Internet from https://www.sweetwater.com/store/detail/CrashGuard--primacoustic-crashguard on Aug. 13, 2018.

Auray, Iso-Armor-2 Pro Isolation Chamber for Recording Microphones Owner's Manual, Sep. 2017, The Gradus Group, Inc., New York, New York.

Aston Microphones Halo Reflection Filter, Sweetwater Sound, downloaded from the Internet from https://www.sweetwater.com/store/detail/AstonHalo-aston-microphones-halo-reflection-filter on Aug. 13, 2018.

Isovox Home Vocal Booth, Sweetwater Sound, downloaded from https://www.sweetwater.com/store/detail/ISOVOX2-isovox-home-vocal-booth on Aug. 13, 2018.

Primacoustic FlexiBooth—Grey https://www.sweetwater.com/store/detail/FlexiBoothG--primacoustic-flexibooth-grey on Aug. 13, 2018.

Antares Mic Mod efx Classic Microphone Modeler Owners Manual, Sep. 2015, Antares Technologies, Scotts Valley, California.

SE Electronics Reflexion Filter-X Assembly and Use, Mar. 2016, sE Electronics, Novato, California.

SE Electronics Reflexion Filter Pro Assembly and Use, Aug. 2016, sE Electronics, Novato, California.

SE Electronics Reflexion Filter Pro Assembly and Use, Jul. 2017, sE Electronics, Novato, California.

SE Electronics Reflexion Filter Space Assembly and Use, Jun. 2016, sE Electronics, Novato, California.

SE Electronics guitarRF Assembly and Use, Jun. 2015, sE Electronics, Novato, California.

Virtual Microphone System Users Guide, Jan. 2017, Slate Digital, Los Angeles, California.

VLMS ML-2 Quick Start Guide, Jun. 2018, Slate Digital, Los Angeles, California.

Technical Specifications Edge, Antelope Audio, downloaded from the Internet from https://en.antelopeaudio.com/products/edge/#specs on Aug. 19, 2018.

Antelope Audio Edge Strip Users Manual, Jun. 2018, downloaded from the Internet from https://support.antelopeaudio.com/support/solutions/articles/42000032116-edge-strip-user-manual on Aug. 19, 2018.

Antelope Audio Edge Users Manual, Jun. 2018, downloaded from the Internet from https://support.antelopeaudio.com/support/solutions/articles/42000016945-edge-user-manual on Aug. 19, 2018.

Antelope Audio Verge Users Manual, Jun. 2018, downloaded from the Internet from https://support.antelopeaudio.com/support/solutions/articles/42000016946-verge-user-manual on Aug. 19, 2018.

Townsend Labs Sphere L22 Precision Microphone System Guide, Oct. 2016, Townsend Labs Inc., Campbell, California.

Mic Room. IK Multimedia, downloaded from the Internet from https://www.ikmultimedia.com/products/trmicroom/ on Aug. 19, 2018.

MicCab AAX-DSP—History of Microphones Annoucement, downloaded from the Internet from https://www.sknoteaudio.com/wp/index.php/2016/09/08/miccab-aax-dsp-history-of-microphones on Aug. 19, 2018.

(56) References Cited

OTHER PUBLICATIONS

ECM 87 Virtual Mic Locker, Gauge Precision Instruments, downloaded from the Internet from https://www.gauge-usa.com/collections/microphones/products/ecm-87-virtual-mic-locker on Aug. 19, 2018.
Daniel J Clark, The Microphone Cabinet Microphone Modeling, a Senior/Honors Thesis (MUMET 495/HONRS 490), May 2006, Ball State University, Munice, Indiana.
Sam Inglis, How Effective are Portable Vocal Booths? Sound on Sound Magazine, Oct. 2014, Sound on Sound Ltd, Cambridge, United Kingdom.
Eric Benjamin, A Soundfield Microphone using Tangential Capsules, Audio Engineering Society Convention Paper 8240, Audio Engineering Society, Nov. 2010, New York, New York.
Matthias Kock et al., Synthesis of Polar Patterns as a Function of Frequency with a Twin Microphone: Audio Examples and Applications within the Creative Process of Music Mixing, Audio Engineering Society Convention Paper 8365, May 2011, Audio Engineering Society, New York, New York.
Christoff Faller, Design and Limitations of Non-Coincidence Correction Filters for Soundfield Microphones, Audio Engineering Society Convention Paper 7766, May 2009, Audio Engineering Society, New York, New York.
Nils Peters et al., Beamforming using a spherical microphone array based on legacy microphone characteristics, International Conference on Spatial Audio 2011, downloaded from the Internet from http://www.icsi.berkeley.edu/pubs/other/beamforming12.pdf on Aug. 23, 2018.
Angelo Farina et al., Measuring Spatial Impulse Responses in Concert Halls and Opera Houses Employing a Spherical Microphone Array, 19th International Congress on Acoustics, Mardrid Sep. 2-7, 2007, downloaded from the Internet from http://www.angelofarina.it/Public/Papers/234-ICA2007.pdf on Aug. 23, 2018.
Eigenmike Microphone, downloaded from the Internet from http://www.mhacoustics.com/mh_acoustics/Eigenmike_microphone_array.html on Aug. 23, 2018.
Polarflex, Schoeps Mikrofone, downloaded from the Internet from https://schoeps.de/en/products/special-microphones/polarflex.html on Aug. 23, 2018.
Auralex Mudguard v2 Microphone Shield, Jan. 2018, Auralex Acoustics Inc, Indianapolis, Indiana.
RealTraps Portable Vocal Booth Assembly, downloaded from the Internet from http://realtraps.com/pvb_assy.htm on Aug. 24, 2018.
Portable Vocal Booth Flex Edition, Editors Keys, downloaded from the Internet from https://www.editorskeys.com/collections/recording-equipment/products/vocal-booth-flex on Aug. 24, 2018.
VoxGuard VU User Guide, Mar. 2015, Radial Engineering Ltd., Port Coquitiam, British Columbia, Canada.
Flexi Screen Ultra, product cut sheet, Mar. 2017, Visound Acustica SA, Pacos de Ferreria, Portugal.
Studiospares RED100 Mic Enhancer, downloaded from the Internet from https://www.studiospares.com/Microphones/Mic-Accessories/Studiospares-RED100-Mic-Enhancer_465160.htm#rtabs1 on Aug. 24, 2018.
Alctron Studio Mic Screens, downloaded from the Internet from: http://www.alctron-audio.com/English/channels/126.html on Sep. 5, 2018.

* cited by examiner

MICROPHONE SOUND ISOLATION BAFFLE AND SYSTEM

BACKGROUND

The present disclosure relates to microphone modeling and microphone sound-isolation baffles typically used for vocal and musical instrument recordings.

Historically, professional or commercial music and voice recordings typically have taken place in recording studios, concert halls, or sound stages. Recording studios, concert halls, and sound stages have generally provided controlled environments, with acoustics optimized for creating pleasing sound and for the control and abatement of noise. For example, a professional recording studio may be constructed so the studio environment is isolated from building, ventilation, and exterior noise. The recording studio is typically treated to control unwanted reflections and room resonances and otherwise balance the sound of the room. In addition, the recording studio is often divided into two rooms: A control room and a live room. The sound engineer operates the recording equipment in the control room. The musicians and vocalist perform in the live room. The live room acoustics are optimized for recording sound. The control room acoustics are optimized for critical listening.

In more recent times, with the explosion of low cost, high-quality, and computer-based audio recording equipment, many professional recordings are no longer made in the ideal professional studio environment described above. Many professional audio recordings for music, television production, or film production take place in less formal settings. These can often be in a home studio of the producer, musicians, or television or film scorers. These so-called project studios often have less than ideal acoustics. They rarely have sound isolation from the ventilation system, the outside environment, or the rest of the building. Often control room and studio functions take place in a single room so the musicians and vocalists are not isolated from equipment noise. In addition, these rooms are typically not acoustically balanced for recording. The combination of environmental noise and non-ideal acoustics creates challenges for creating professional high-quality audio recordings.

In recent years, microphone sound-isolation baffles were developed to address these challenges. Microphone sound-isolation baffles attempt to isolate the microphone and performer or the microphone and musical instrument from the acoustics of the room by partially surrounding the microphone. The microphone sound-isolation baffle can use sound absorption to control sound reflections. The microphone sound-isolation baffle can use a combination of sound absorption and reflection to reduce unwanted ambient noise. The microphone sound-isolation baffle typically does this while attempting to minimize added coloration (i.e. changing the audio frequency response) of the sound from the performer or musical instrument.

Traditionally, professional recording studios may invest in new high-quality studio condenser and ribbon microphones. For example, Neumann U87, Neumann U67, or the Sony C800G. They may also invest in classic microphones that are no longer being manufactured. For example, the Neumann U47, M50, or M49. The cost of these microphones is often beyond the budget of many project studios. Microphone modeling, also known as microphone emulation, was developed, to emulate the sound of these classic microphones, and bring this sound within the reach of project studios.

Microphone modeling works by recording audio, such as voice or musical instruments, and then applying a software model or some other post-processing of the emulated microphone to the recorded audio. A microphone used to record audio, such as a musical performance (i.e., voice and/or musical instruments), is called the source or reference microphone. The microphone modeled or emulated is called the target or destination microphone.

Some commercially available microphone modeling products allow the user to select a source microphone from a list of microphones and then choose a target microphone from another list of microphones. The source microphone list typically includes microphones commonly found in recording studios. The target microphone list typically includes sought after classic microphones such as those discussed in the preceding paragraph.

Other commercially available microphone modeling products require the user to record music using a reference microphone provided or recommended by the microphone modeling manufacturer. The reference microphone typically exhibits more tightly controlled frequency response and other characteristics so that the microphone modeler has a known starting point. Like in the first modeling scheme, the user would select from a list of target microphones to emulate. The reference microphone is typically a high-quality microphone and can have quality comparable to some of the classic target microphones. The reference microphone can generally produce more accurate and transparent sound reproduction than the general selection of source microphones in the first schedule.

Microphone modeling developers create the microphone models typically by recording each source microphones and each target microphones, one at a time, in a controlled studio environment or anechoic chamber using test signals. For example, the microphone modeling software manufacturer may record either a source microphone or target microphone using test signals, such as sine-sweep, noise, or impulses through the microphones so the frequency response and other characteristics of the microphone can be measured. Using the model of the source microphone, the microphone modeler, in effect, attempts to cancel the sonic contribution of the source microphone and then apply the modeled response of the target microphone to the signal.

SUMMARY

Project studios may use microphone sound-isolation baffles because of less than optimal acoustics may also use microphone modeling products to emulate classic microphones. Typically, a studio engineer would attempt to reduce room noise by positioning the microphone sound-isolation baffle near the source microphone. In addition, using microphone modeling software, the studio engineer would choose a target microphone for emulation The inventor noted that the scenario described in the preceding paragraph can led to less than optimal results. Because microphone sound-isolation baffles inevitably reflect some sound, in addition to absorbing sound, changes in the frequency response characteristics of the microphone will occur, such as amplifying low frequencies which are reflected back toward the microphone. With this in mind, the inventor made measurements of a reference and target microphones with and without a microphone sound-isolation baffle. It then becomes possible to create a microphone modeling system that emulates a target microphone and that reduces or cancels the sonic contribution of the microphone isolation baffle. Typically, this microphone modeling system could include a processor configured to receive and act on a microphone capsule signal from within the reference microphone, emulate a user selected target microphone on-axis microphone model frequency response, and reduce the sonic contribution of the microphone sound-isolation baffle based on a modeled response of the microphone sound-isolation baffle. The microphone modeling system could be structured to work with single-capsule microphones or multiple capsule microphones, such as dual-capsule microphones.

To achieve this, the inventor discovered that the microphone sound-isolation baffle must be positioned in a predetermined distance and rotational position with respect to the reference microphone when the modeling measurements are made and the same position when used by the end-user. In order to realize accurate compensation of a microphone sound-isolation baffle, the inventor developed an improved microphone sound-isolation baffle that can be reliably set to a predetermined distance and rotational position from a specific reference microphone. Commercially available microphone sound-isolation baffles are continuously adjustable to accommodate many microphone shapes and sizes and therefore cannot be reliably set a predetermined distance and rotational position from a specific reference microphone.

The inventor envisions that a microphone sound-isolation system could comprise a microphone and a microphone sound-isolation baffle removable from the microphone and settable to a predetermined distance and a predetermined rotational angle with respect to the microphone. The microphone being operable with or without the microphone sound-isolation baffle. The microphone sound-isolation baffle could be set to the predetermined rotational angle by using a combination of a first alignment portion on the microphone, and a second alignment portion on the microphone isolation filter. Optionally, a first alignment portion and a second alignment portion together fix the microphone to the predetermined rotational angle. The inventor envisions this could be implemented in several ways. For example, the first alignment portion could be a first indicia and the second alignment portion could be a second indicia. As another example, the first alignment portion could be captively slidable with the second alignment portion.

In addition, the inventor anticipates that auto-detection of presence or absence of the microphone sound-isolation baffle when the microphone is being used may be desirable. To achieve this purpose, the inventor envisions that the microphone sound-isolation system could include a microphone sound-isolation baffle detection circuit. The processor could then be configured to reduce the sonic contribution of the microphone sound-isolation baffle when the microphone sound-isolation baffle detection circuit detects the presence of the microphone sound-isolation baffle in combination with the reference microphone.

One reason for using a microphone sound-isolation baffle is to isolate the microphone from ambient noise and the effects of room acoustics. With this in mind, the inventor reasoned that he could use the microphone sound-isolation baffle and microphone modeling in combination with active noise cancelation to further reduce the effect of ambient noise and room acoustics. The inventor further envisions that he could achieve this by using one or more auxiliary microphones positioned to receive the off-axis signal outside of the microphone sound-isolation baffle. The processor can receive and act on an auxiliary microphone signal and adaptively cancel portions of the auxiliary microphone signal from the microphone capsule signal that is common to the microphone capsule signal.

This Summary introduces a selection of concepts in simplified form described the Description. The Summary is not intended to identify essential features or limit the scope of the claimed subject matter.

DRAWINGS

DESCRIPTION

Figure 1:
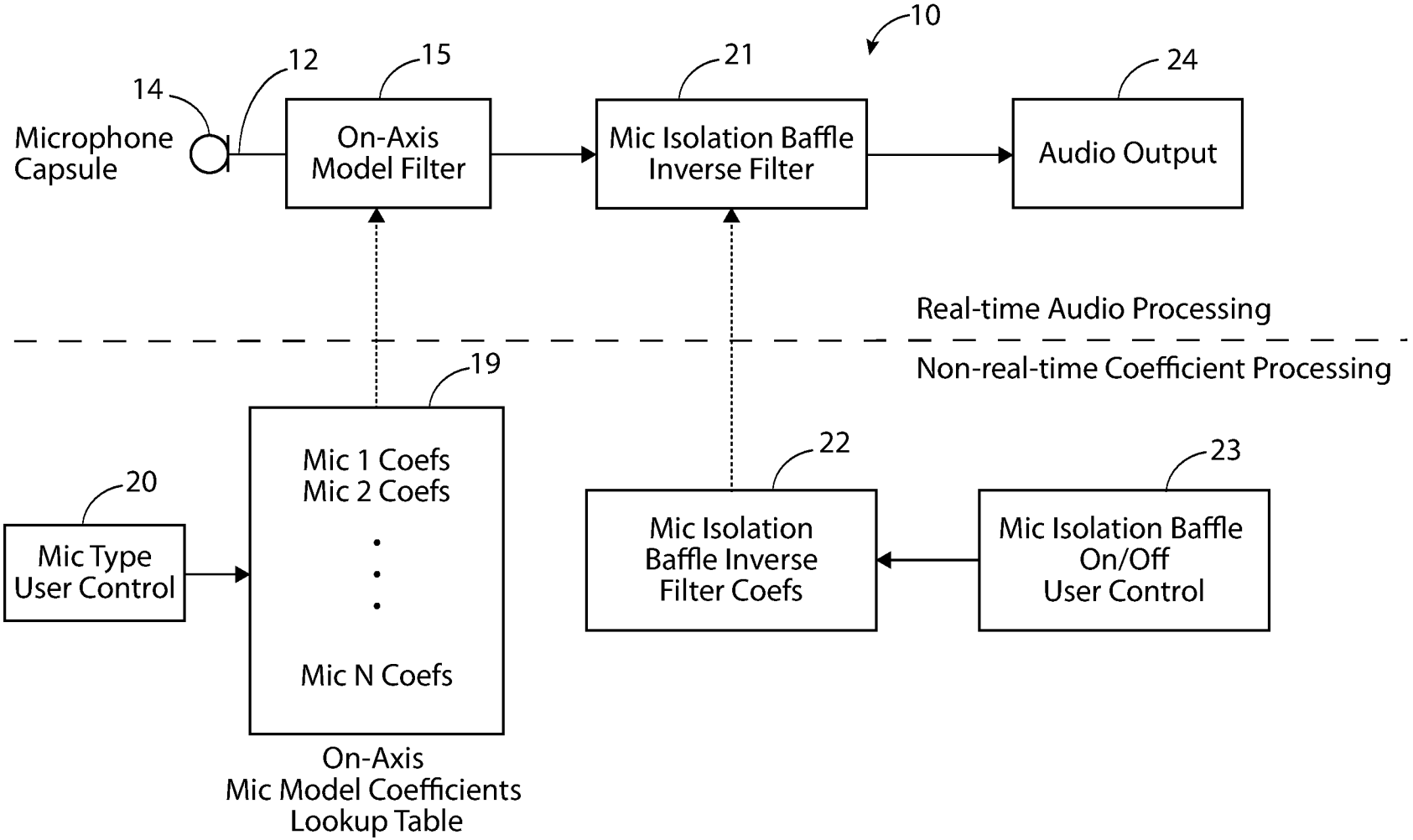
FIG. 1 illustrates a block diagram of a microphone modeling system with a single-capsule microphone capable of compensating for a microphone sound-isolation baffle.

The terms "left," "right," "top, "bottom," "upper," "lower," "front," "back," and "side," are relative terms used throughout the Description to help the reader understand the figures. Unless otherwise indicated, these do not denote absolute direction or orientation and do not imply a particular preference. When describing the figures, the terms "top," "bottom," "front," "rear," and "side," are from the perspective of front of the microphone. Specific dimensions should help the reader understand the scale and advantage of the disclosed material. Dimensions given are typical and the claimed invention is not limited to the recited dimensions. In FIGS. 1, 2, 8, 20, 21, 22B, and 23B, "Mic" is an abbreviation for microphone.

The "user controls" illustrated in FIGS. 1, 2, 8, 21, 22A, 22B, 23A, and 23B can be hardware controls such as potentiometers, pulse potentiometers (pulse pots), encoders, switches, or other hardware implemented controls known to those skilled in the art. User controls can be software controls and implemented on a graphical user interface. An example of a graphical user interface 47 is illustrated in FIG. 9.

FIGS. 1, 2, 8, 21, 22A and 22B, and 23A and 23B illustrate microphone modeling systems 10, 11, 43, 73, 80, 109, respectively. The signal blocks, for example, on-axis model filters, inverse microphone sound-isolation baffle filters, beamforming filters, adaptive noise control filters, or proximity compensation filters within the microphone modeling systems 10, 11, 43, 73, 80, 109 can be implemented using processors within laptop, desktop, mobile computing devices, microphones, or dedicated audio processing units with sufficient computing power to process audio signal paths of the microphone modeling systems.

The following terms are used throughout this disclosure and are defined here for clarity and convenience.

Microphone: As defined in this disclosure, a microphone converts acoustic energy into a corresponding analog electric current and voltage or an analogous digital signal. As used throughout this disclosure, the term microphone refers to an assembly that includes a housing, microphone capsule, and electrical interface.

Reference Microphone: As defined in this disclosure, a reference microphone, or source microphone, is a microphone used to record audio, such as a musical or vocal performance, for the microphone modeling system.

Target Microphone: As defined in this disclosure, a target or destination microphone is a microphone that has been modeled by a microphone modeling system that is to be emulated by microphone modeling system.

Microphone sound-isolation baffle: As defined in this disclosure, a microphone sound-isolation baffle is a removable add-on device (i.e. the microphone can be used without it) that partially surrounds a microphone and includes predominantly sound absorbing material and/or sound diffusing material facing the microphone, and predominantly sound absorbing and/or sound reflecting material facing away from a microphone. A microphone sound-isolation baffle is not a microphone pop filter or a windscreen although a pop filter or windscreen might be included as a part of the microphone sound-isolation baffle. A microphone pop filter, also known as a pop shield, attempts to reduce sound with high air flow, such as pop sounds, while being transparent to desired sounds coming into the microphone. Pop sounds are typically caused by singing or vocalizing plosive sounds which produce a relatively high air flow from the mouth. A windscreen is designed to remove wind noise and generally is uniform in structure because wind can come from any direction relative to the microphone.

Figure 2:
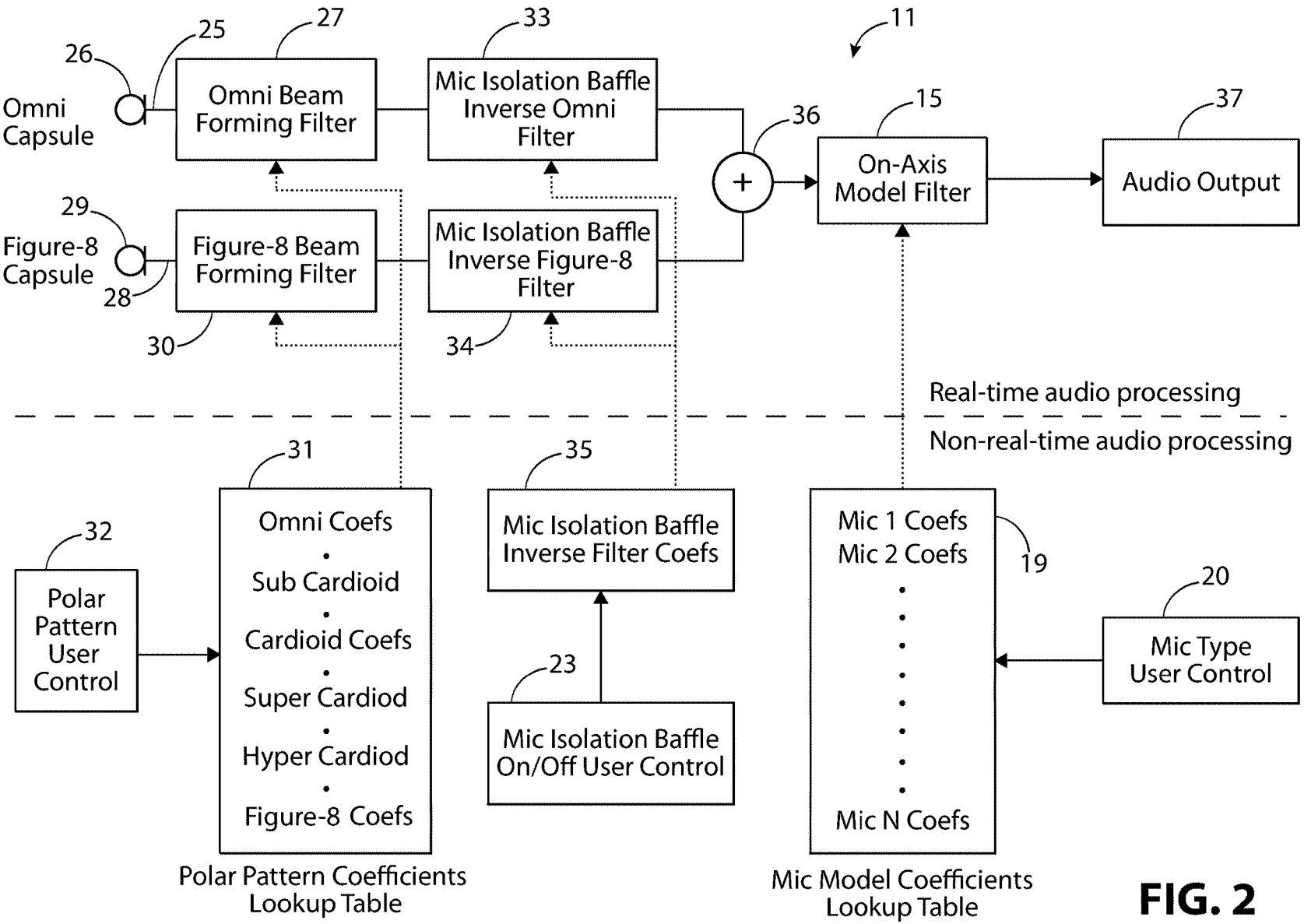
FIG. 2 illustrates a block diagram of a microphone modeling system with a dual-capsule microphone capable of compensating for a microphone sound-isolation baffle.

FIG. 1 illustrates a block diagram of a microphone modeling system 10 with a single-capsule microphone capable of compensating for a microphone sound-isolation baffle. FIG. 2 illustrates a block diagram of a microphone modeling system 11 with two microphone capsules capable of compensating for a microphone sound-isolation baffle. Referring to FIG. 1, a digitized version of a microphone signal 12 from a microphone capsule 14 feeds an on-axis microphone model filter 15. The microphone capsule 14 would typically be within a studio or reference microphone. For example, the microphone 17 in FIGS. 3-7, the microphone 18 in FIGS. 10-13, 16, and 17, or the microphone 58 of FIGS. 18 and 19 which all could be implemented with one or more microphone capsules. This digitized version of the microphone signal 12 results from an analog-to-digital conversion process. Conversion circuitry, such as a microphone preamplifier combined with an analog-to-digital converter (ADC), is well-known and omitted for brevity.

Figure 3:
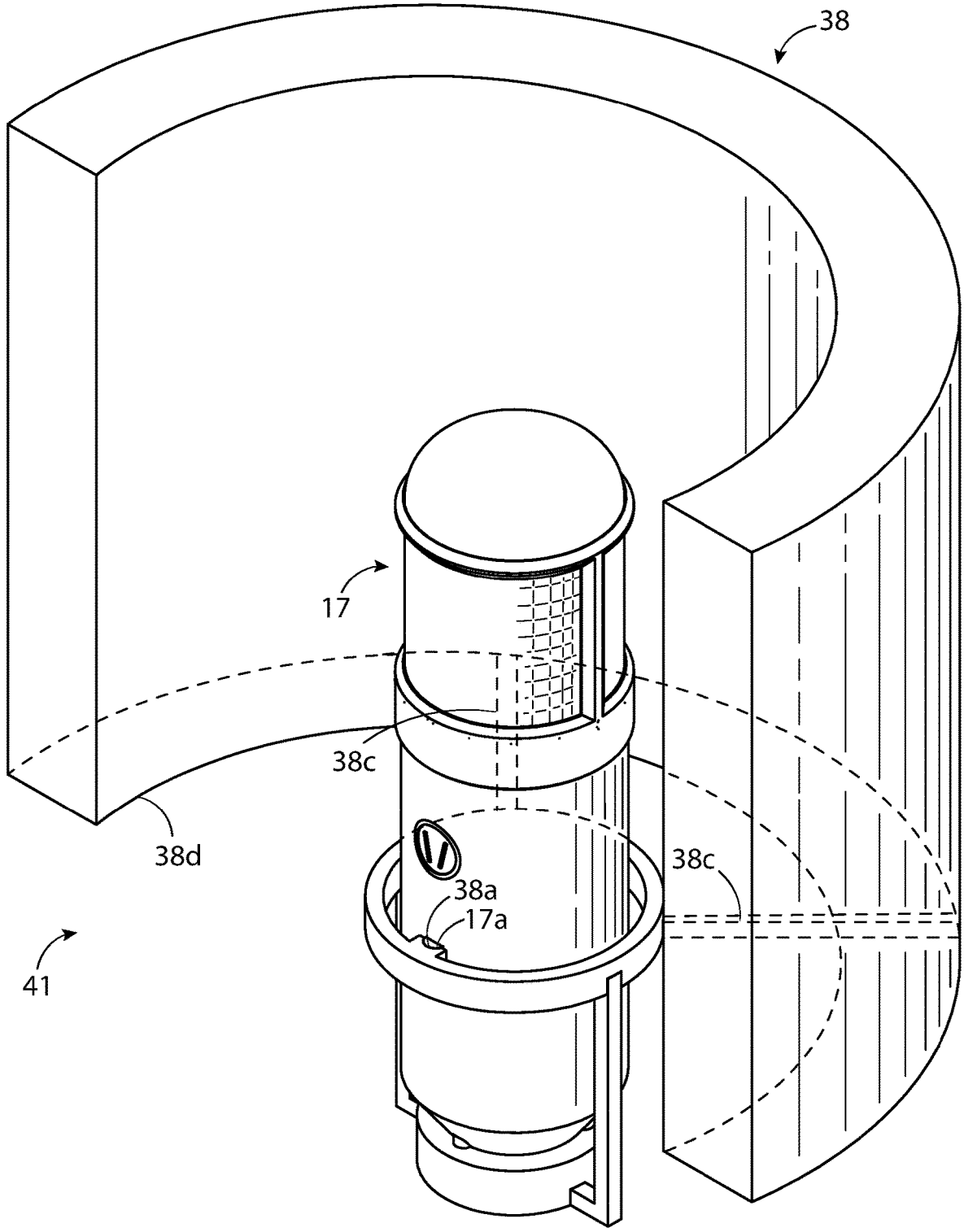
FIG. 3 illustrates a first example of a microphone sound-isolation baffle and a microphone in front and left perspective view.
Figure 9:
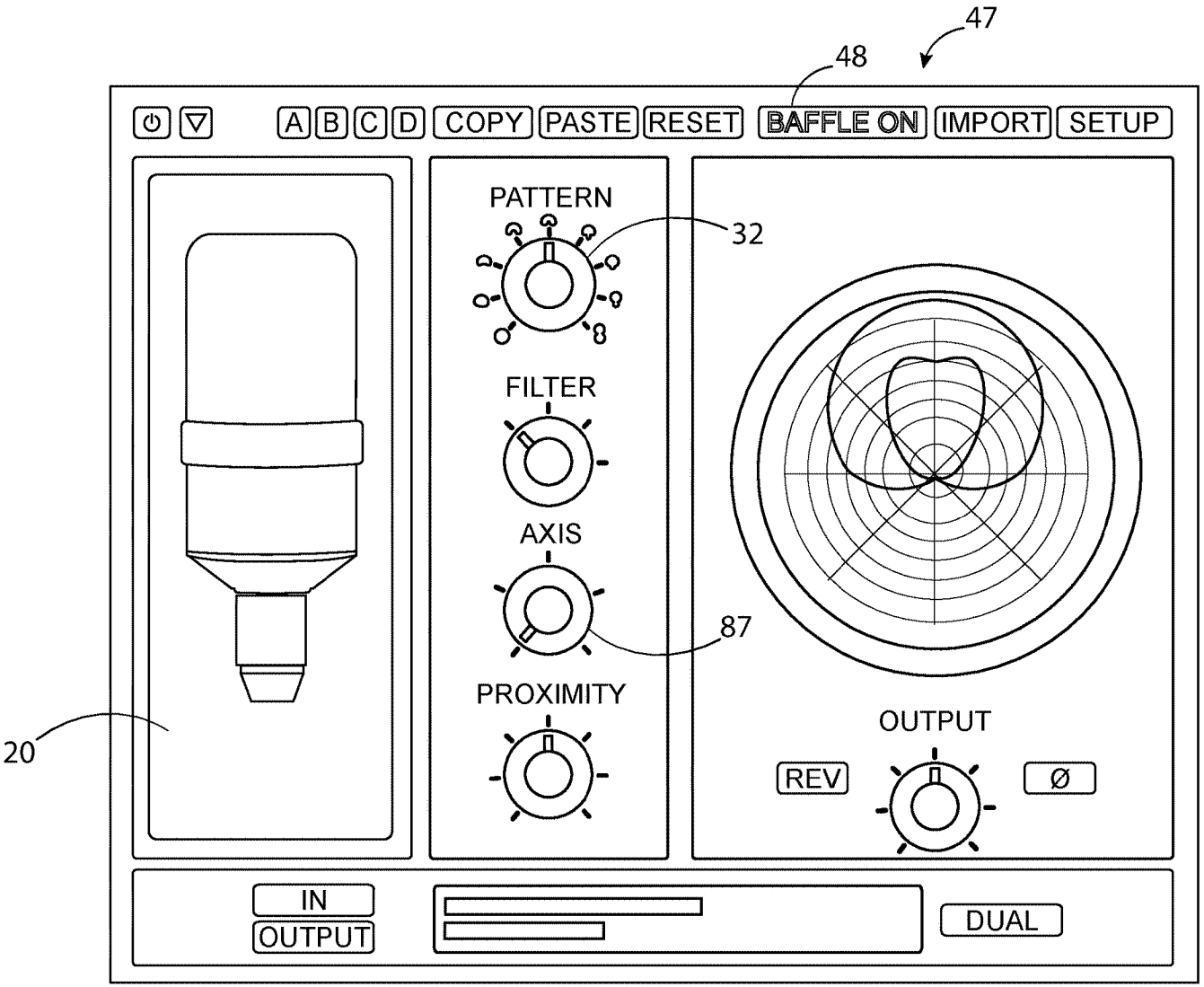
FIG. 9 illustrates a typical graphical user interface illustrating a baffle on/off indicator or alternatively a baffle on/off indicator.
Figure 10:
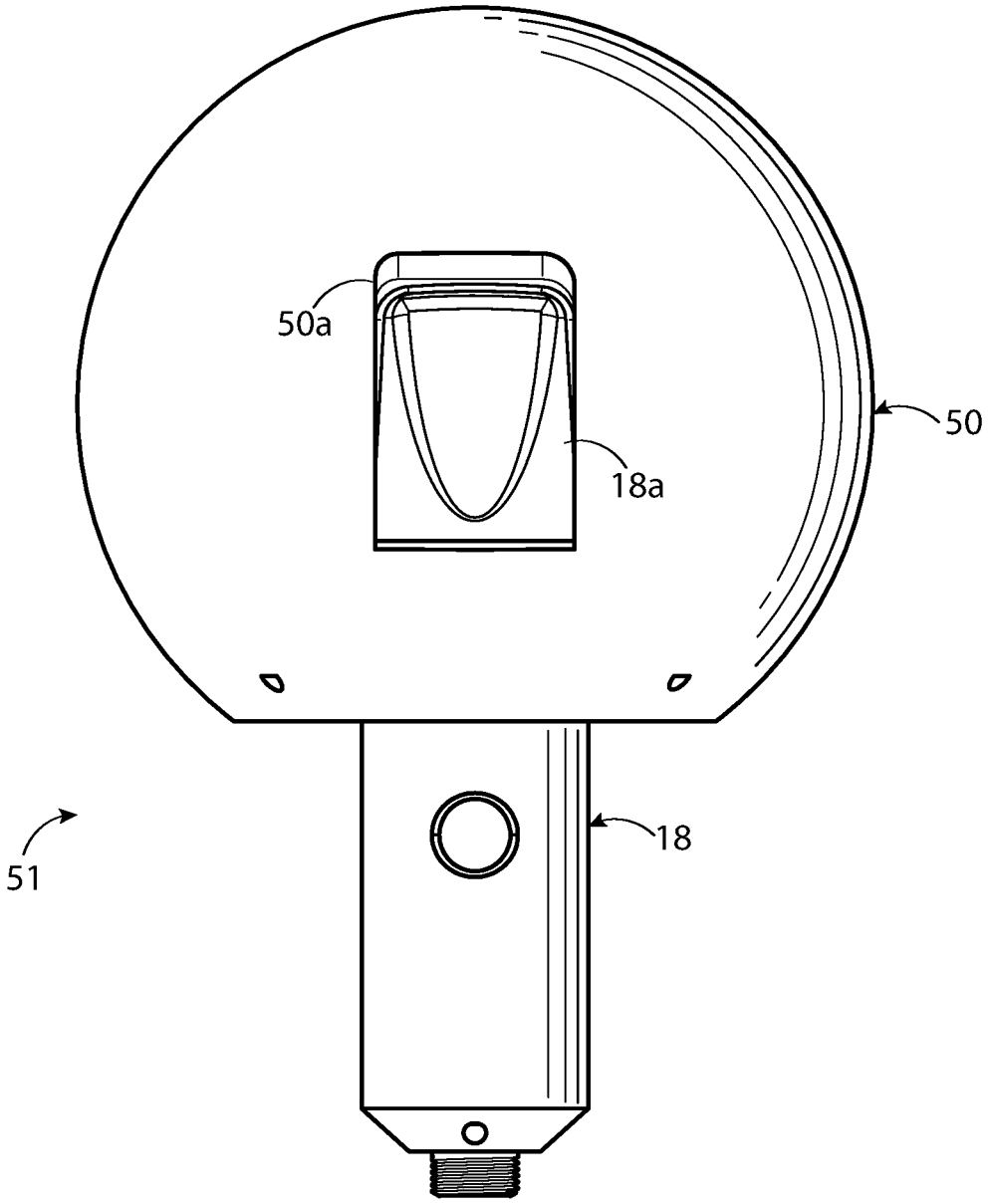
FIG. 10 illustrates a third example of a microphone sound-isolation baffle and a microphone that include alignment indicia, in front view.
Figure 11:
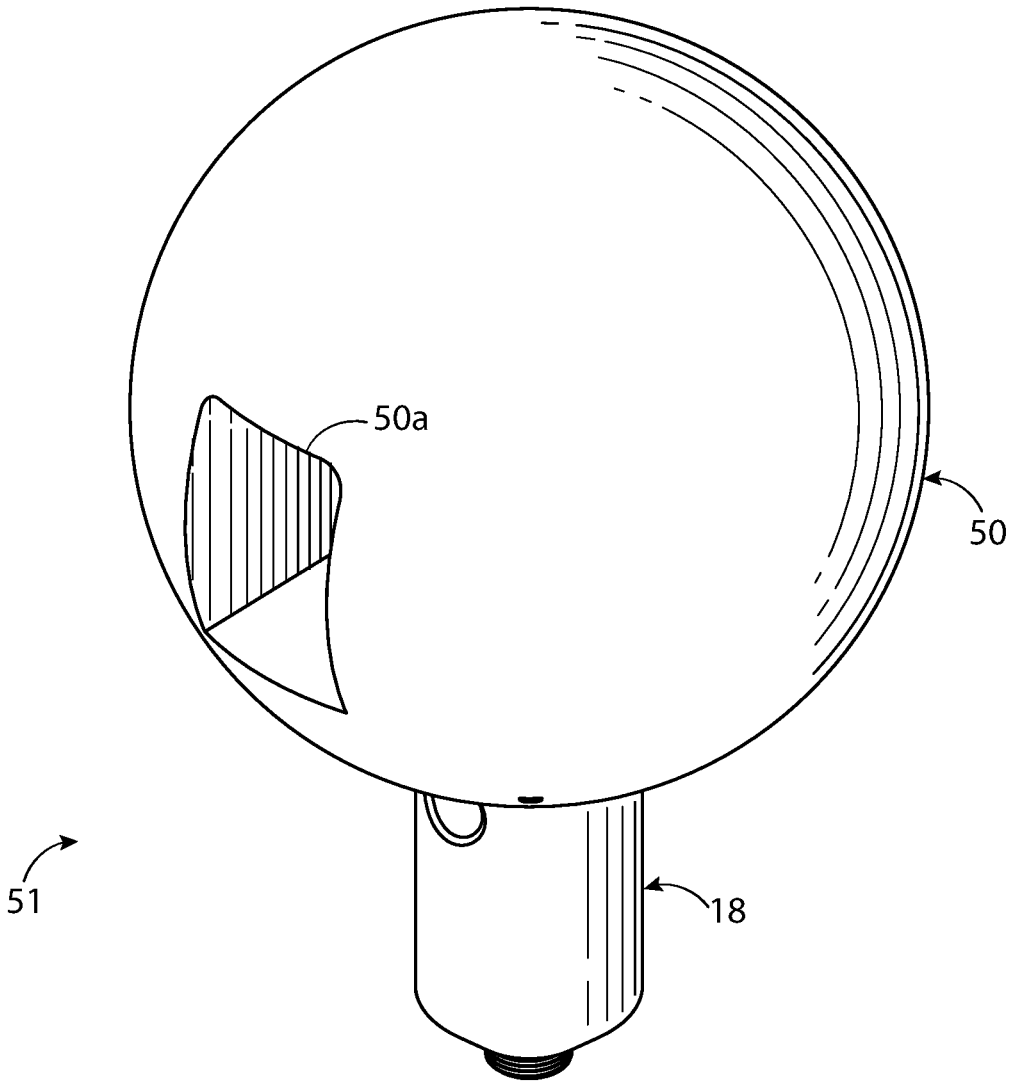
FIG. 11 illustrates the microphone sound-isolation baffle and microphone of FIG. 10 in front and left perspective view.

The on-axis microphone model coefficient lookup table 19 takes the known frequency response of a reference microphone, such as microphone 17 of FIG. 3 or microphone 18 of FIG. 10, and maps coefficients on to the on-axis microphone model filter 15 to create a frequency response that emulates the on-axis frequency response of a target microphone. The user can select what target microphone they wish to emulate using the microphone type user control 20. The microphone type user control 20 can be implemented in hardware, for example with a potentiometer, pulse-pot, or encoder. It can be a virtual or software control, such as the microphone type user control 20 in the graphical user interface 47 of FIG. 9. Some typical target microphones could include Neumann U87, U67, M49, M50, AKG C414, Sony C800G, or the reference microphone itself. This list is not meant to be exhaustive or limiting but merely examples of what could typically be emulated.

The coefficients for the on-axis microphone model filter 15 used throughout this disclosure can be created by taking anechoic on-axis measurements of the target microphone's impulse or frequency response. If the microphone offers selectable polar patterns or other options, the measurements may be done for each combination of settings. If using a finite impulse response (FIR) filter implementation, the impulse response can be converted directly to filter coefficients. For an infinite impulse response (IIR) filter implementation, a filter algorithm such as Prony or Steiglitz-McBride can be used to match the filter coefficients to the impulse response. The coefficients are stored as discrete sets. Adjustment of the on-axis microphone filter can be continuous with a large number of sets and interpolation between coefficients.

The output of the on-axis microphone model filter 15 feeds the microphone sound-isolation baffle inverse filter 21. Using a model of the target microphone with and without a model of the microphone sound-isolation baffle, the microphone sound-isolation baffle inverse filter 21 removes the on-axis frequency coloration caused by the microphone sound-isolation baffle. The microphone sound-isolation baffle inverse coefficients 22 maps the inverse frequency response coefficients of the modeled microphone sound-isolation baffle onto the microphone sound-isolation baffle inverse filter 21. The user can select whether the baffle is present or not using the microphone sound-isolation baffle on/off user control 23. The resulting audio output 24 compensates for the microphone isolation filter and produces an on-axis response that closely models the target microphone.

Figure 8:
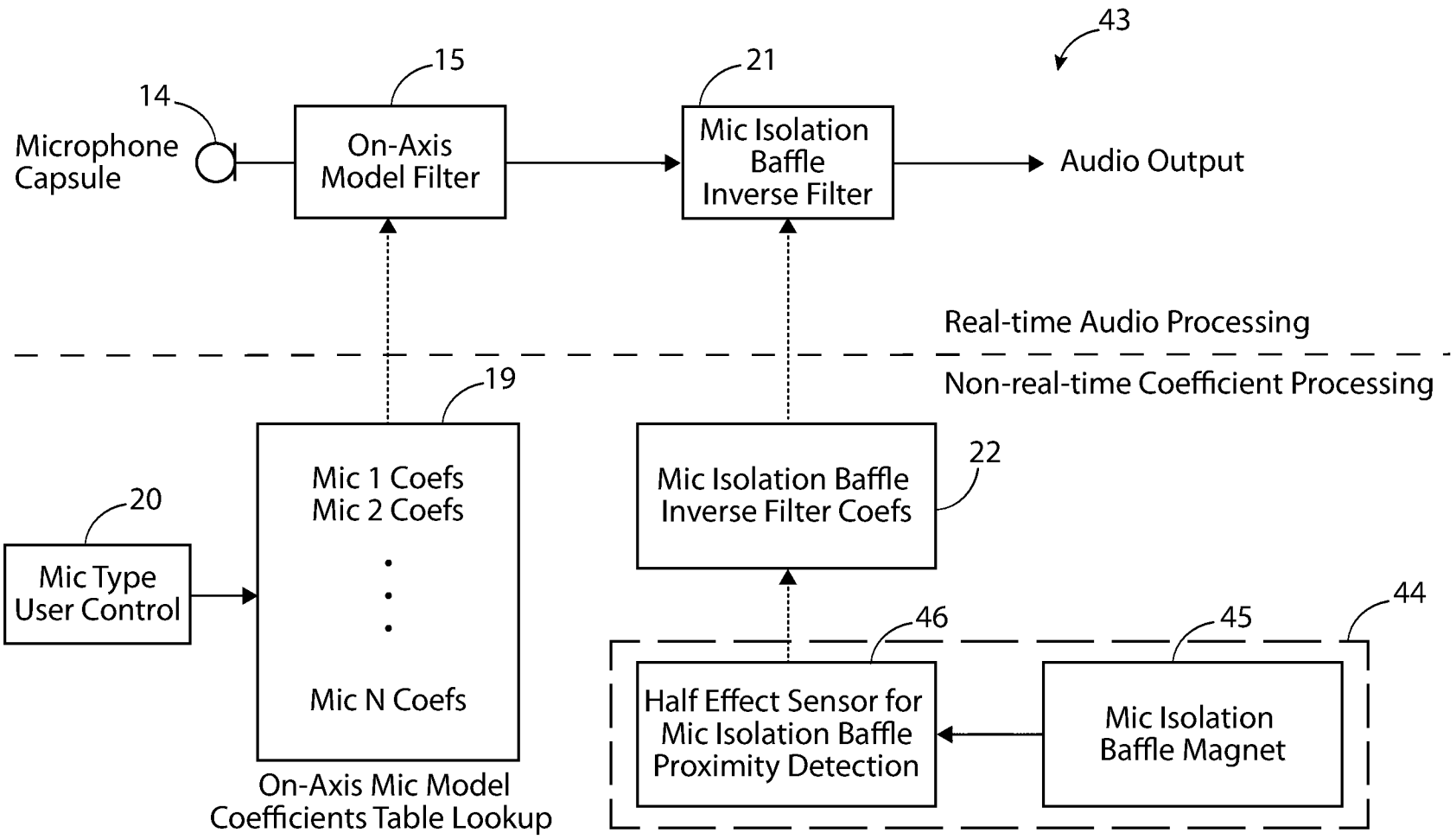
FIG. 8 illustrates a block diagram of a microphone modeling system with automatic detection of the microphone sound-isolation baffle.

The microphone sound-isolation baffle filters described throughout this disclosure including the microphone sound-isolation baffle inverse filter 21 of FIGS. 1 and 8, and the first microphone sound-isolation baffle inverse filter 33 and the second microphone sound-isolation baffle inverse filter 34 of FIGS. 2, 21, 22A, 23A can be implemented with least means squares, genetic algorithms, neural networks, or other methods that train the processor to convert the response of the reference microphone to match the on-axis frequency response of the target microphone. The microphone sound-isolation baffle inverse coefficients used throughout this disclosure including the microphone sound-isolation baffle inverse coefficients 22 of FIGS. 1 and 8, and the microphone sound-isolation baffle inverse coefficients 35 of FIGS. 2, 21, 22A, 23A can be implemented by taking frequency response measurements of the target microphone with and without the microphone sound-isolation baffle.

The inventor's discovery that it is possible to compensate for the on-axis effects of a microphone sound-isolation baffle has several advantages. First, musical instrument or vocal performance recorded in less than ideal acoustic conditions can gain benefit from a microphone sound-isolation baffle without the microphone sound-isolation baffle's on-axis sonic coloration. Second, a single-capsule reference microphone with a single microphone sound-isolation baffle can emulate target microphones without the on-axis sonic coloration of the microphone sound-isolation baffle.

While the inventor found that compensating for the on-axis effect of a microphone sound-isolation baffle is desirable, the inventor discovered that modeling the on-axis response of the reference microphone, the microphone isolation filter, and the target microphone, as well as adjusting the off-axis response of a reference microphone for maximum isolation can have additional advantages. First, microphone isolation filters can cause off-axis sonic coloration. Adjusting both on-axis response and off-axis responses for maximum isolation can improve this. Second, at low frequencies, the total response of the microphone sound-isolation baffle and microphone can tend to become more omnidirectional because the low-frequency off-axis sound will diffract around the microphone sound-isolation baffle and enter the front of the microphone capsule. Beamforming filters, such as those shown in FIGS. 2, 21, and 23A can help compensate for this effect. The microphone modeling systems 11, 73, 80, 109 of FIGS. 2, 21, 22A and 22B, and 23A and 23B are examples of systems that include microphone sound-isolation baffles that adjust both on-axis and off-axis responses.

FIG. 2 illustrates a block diagram of a microphone modeling system 11 with a dual-capsule microphone capable of adjusting both the on-axis and off-axis response of a microphone sound-isolation baffle. Referring to FIG. 2, a digitized version of a first microphone signal 25 from a first microphone capsule 26 feeds a first beamforming filter 27. A digitized version of a second microphone signal 28 from a second microphone capsule 29 feeds a second beamforming filter 30. The first microphone capsule 26 and the second microphone capsule 29 are within a reference microphone and are often back-to-back. For example, dual-capsule versions of the reference microphones, the microphone 17 in FIGS. 3-7, the microphone 18 in FIGS. 10-13, 16, and 17, or the microphone 58 in FIGS. 18 and 19. The digitized version of the first microphone signal 25 and the digitized version of the second microphone signal 28 results from an analog-to-digital conversion process. As discussed for FIG. 1, conversion circuitry, such as a microphone preamplifier combined with an ADC, is well-known and omitted for brevity.

The first beamforming filter 27 and the second beamforming filter 30 each have their filter coefficients adjusted by the polar pattern coefficients lookup table 31. The polar pattern coefficients lookup table 31 includes coefficients for the polar patterns. For example, omnidirectional, a sub-cardioid, cardioid, super-cardioid, hyper-cardioid, and figure-eight. The user can select a polar pattern using the polar pattern user control 32. When the reference microphone is used with the microphone sound-isolation baffle, a cardioid, super-cardioid, or hyper-cardioid pattern typically would achieve the most isolation from off-axis sound. An omnidirectional pattern generally would not be selected by the user when using a sound-isolation baffle because the baffle does not allow the microphone to achieve equal response in all directions.

The first beamforming filter 27 and the second beamforming filter 30, as well as other beamforming filters described within this disclosure can be implemented using optimization techniques such as least squares, minimax, or genetic algorithms. The optimization process can ensure that the on-axis response is equal to the desired on-axis modeled microphone response, and the off-axis response is optimized to produce a response with maximum sound rejection. For minimax optimization, the maximum error in any one particular direction is minimized. For least squares optimization, then "maximum sound rejection" means minimizing the Euclidean distance between the desired and actual complex frequency dependent polar response.

For example, least squares can be implemented with the formula:

$$H=[C^TC+BI]^{-1}C^TA \tag{1}$$

where:

H=matrix of beamforming filters;

A=desired response at multiple angles of incidence;

C=measured response of microphone capsules at multiple angles of incidence;

B=regularization parameter to limit beamforming filter gain within reasonable bounds; and I=identity matrix.

All variables are matrices, so that the optimization can account for any number of capsules and angle of incidence measurements. The computation can be performed either in the time domain or the frequency domain. C is the matrix of anechoic frequency response measurements at multiple angles of incidence of the actual microphone capsules with or without the sound-isolation baffle.

The output of the first beamforming filter 27 feeds a first microphone sound-isolation baffle inverse filter 33. The output of the second beamforming filter 30 feeds a second microphone sound-isolation baffle inverse filter 34. Using a model of the reference microphone with and without the microphone sound-isolation baffle, the first microphone sound-isolation baffle inverse filter 33 and the second microphone sound-isolation baffle inverse filter 34, removes the on-axis frequency coloration caused by a microphone sound-isolation baffle while maximizing off-axis rejection and potentially reducing off-axis coloration. The microphone sound-isolation baffle inverse coefficients 35 maps the inverse frequency response coefficients of the reference microphone sound-isolation baffle onto the first microphone sound-isolation baffle inverse filter 33 and the second microphone sound-isolation baffle inverse filter 34. The user can select whether the baffle is present or not using the microphone sound-isolation baffle on/off user control 23.

The output of the first microphone sound-isolation baffle inverse filter 33 and the output of the second microphone sound-isolation baffle inverse filter 34 are summed by a summing element 36. The summed output feeds the on-axis microphone model filter 15. As described, the on-axis microphone model coefficient lookup table 19 takes the known frequency response of a reference microphone, such as microphone 17 of FIG. 3 or microphone 18 of FIG. 10, and adjusts the on-axis microphone model filter 15 coefficients to create a frequency response that emulates the on-axis frequency response of a target microphone. The user can select what target microphone they wish to emulate using the microphone type user control 20 as described. The resulting audio output 37 compensates for both the on-axis and off-axis response of a modeled microphone isolation filter.

Figure 18:
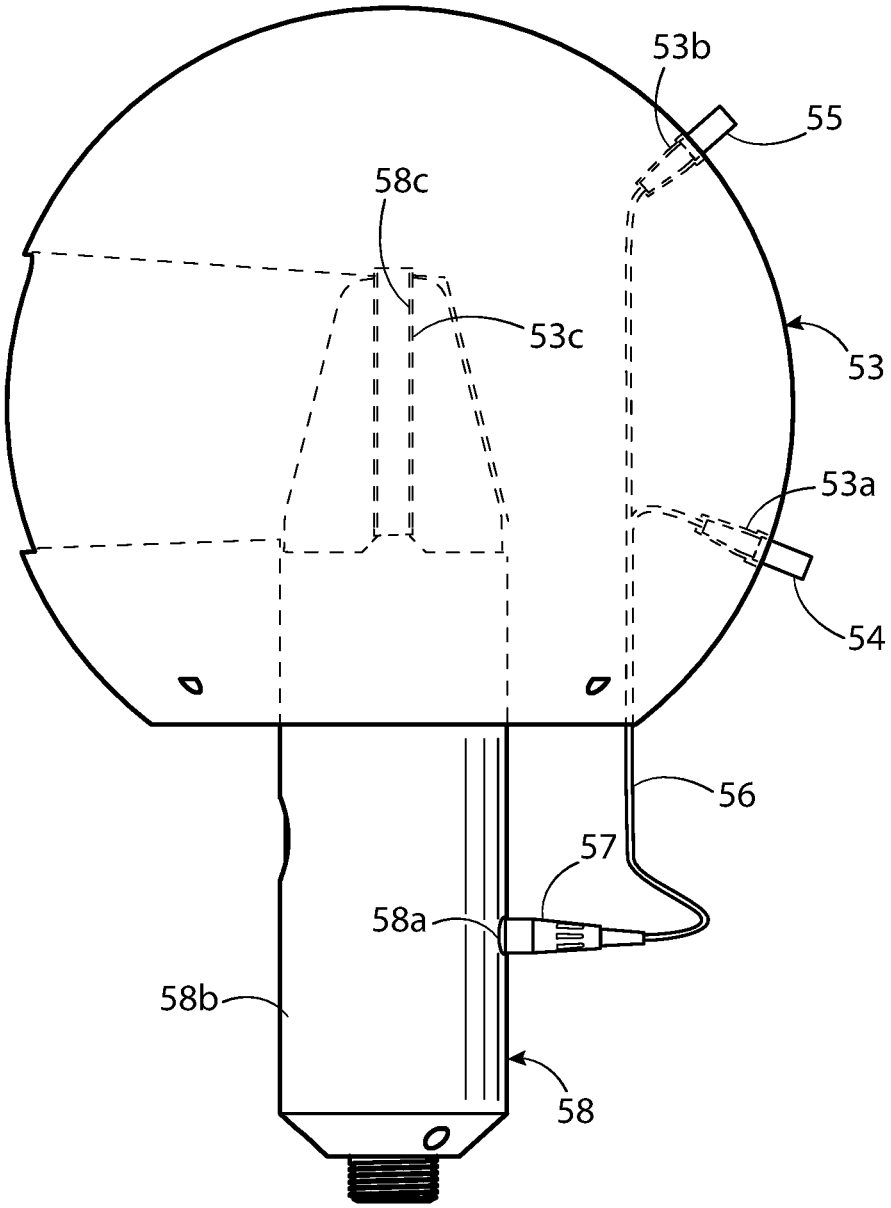
FIG. 18 illustrates a microphone sound-isolation baffle, a microphone, and external microphones mounted on the microphone sound-isolation baffle for noise cancelation.
Figure 19:
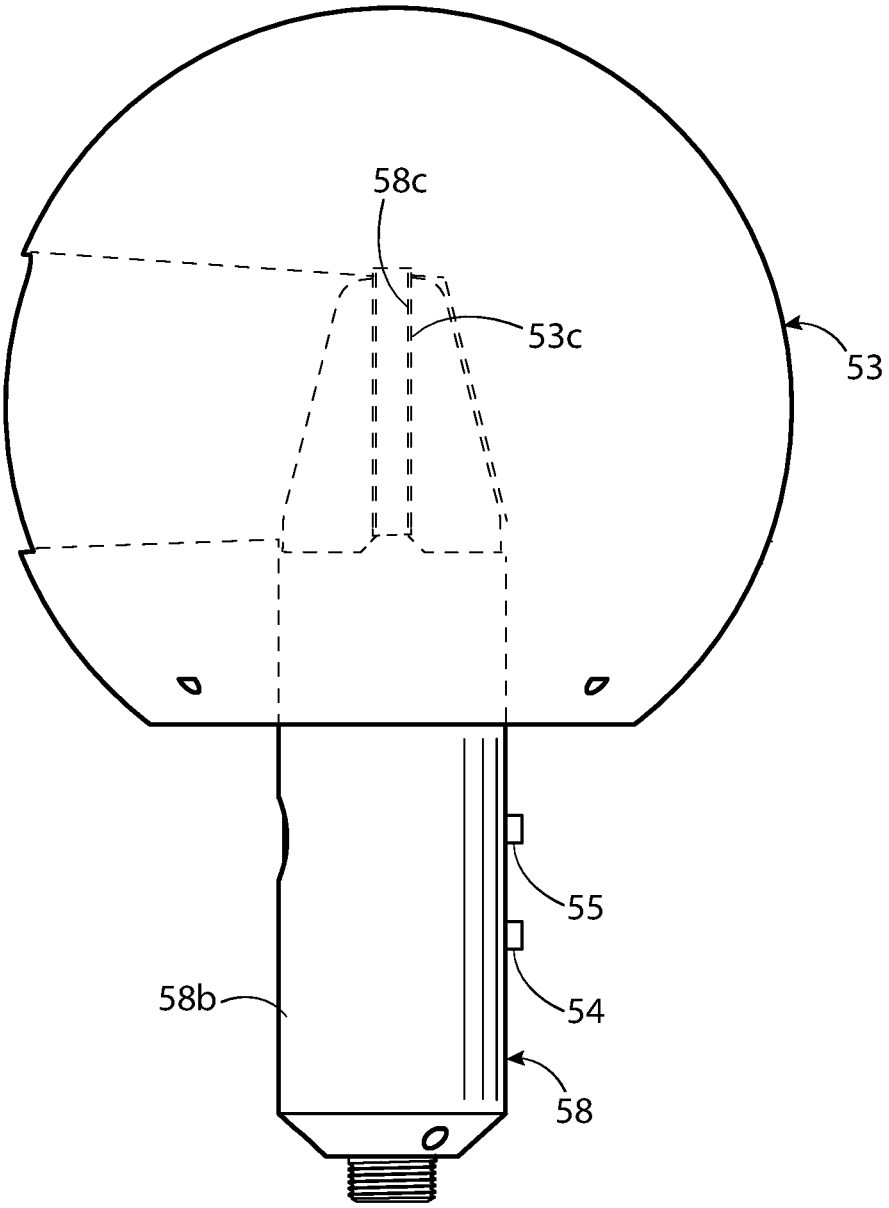
FIG. 19 illustrates a microphone sound-isolation baffle, a microphone, and external microphones mounted on the microphone for noise cancelation.

The microphone modeling system 10 and the microphone modeling system 11 both require accurate measurement of the microphone isolation filter to get better results. The inventor discovered that he could create a more accurate model by positioning the microphone sound-isolation baffle at a predetermined distance and rotational position with respect to the reference microphone and require that the user position the microphone sound-isolation baffle at the same predetermined distance and rotational position with the respect to the microphone sound-isolation baffle. In order to realize accurate modeling of a target microphone by a reference microphone with and without the microphone sound-isolation baffle, the inventor developed an improved microphone sound-isolation baffle that can be reliably set to a predetermined distance and rotational position from a specific reference microphone. The microphone sound-isolation baffle 38 of FIGS. 3-5, microphone sound-isolation baffle 39 of FIGS. 6 and 7, the microphone sound-isolation baffle 50 of FIGS. 10-17, or the microphone sound-isolation baffle 53 of FIGS. 18 and 19 are examples of microphone sound-isolation baffles using these principles developed by the inventor.

Figure 4:
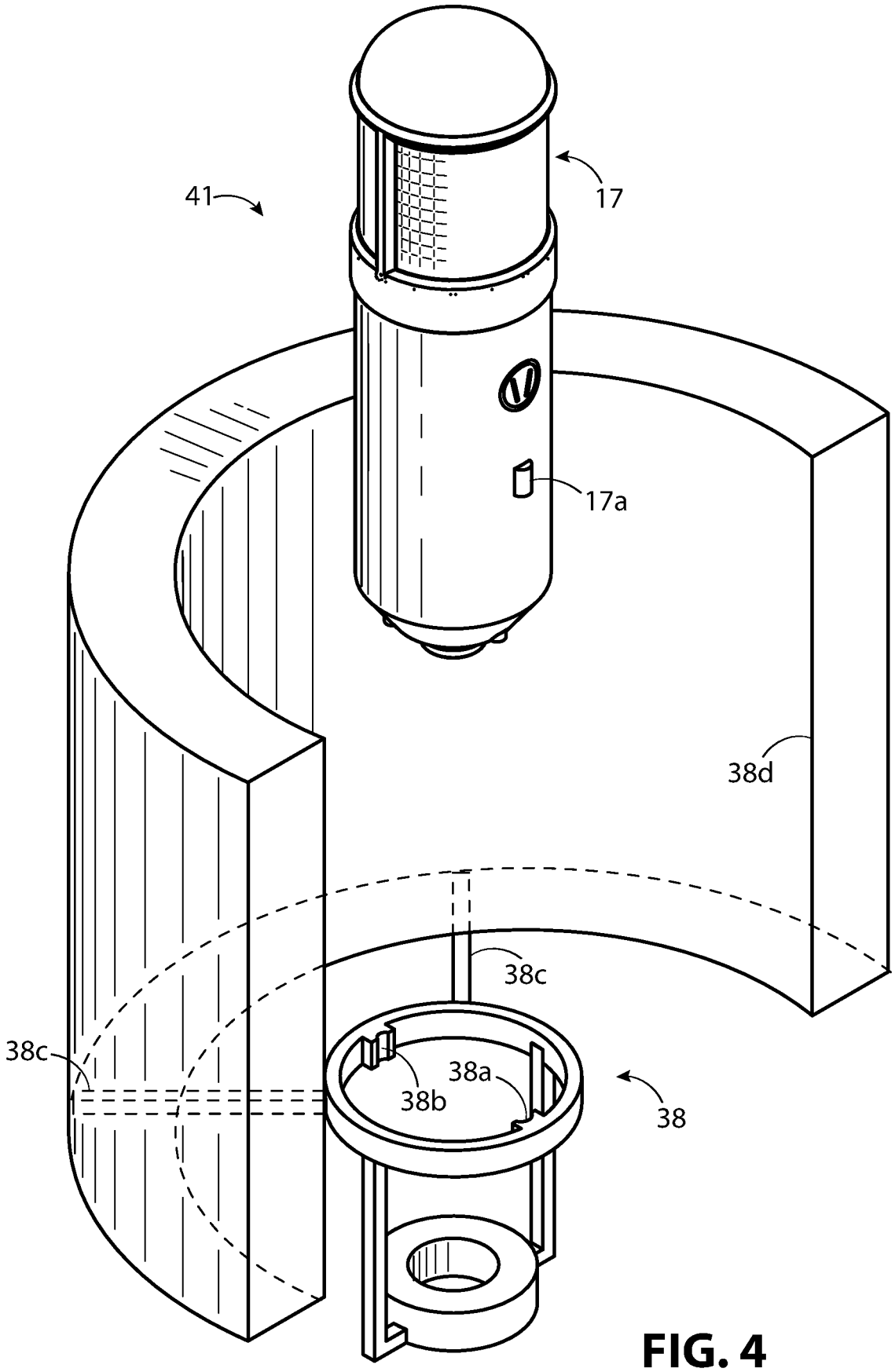
FIG. 4 illustrates the microphone sound-isolation baffle and the microphone of FIG. 3 in front, right, and exploded perspective view.
Figure 5:
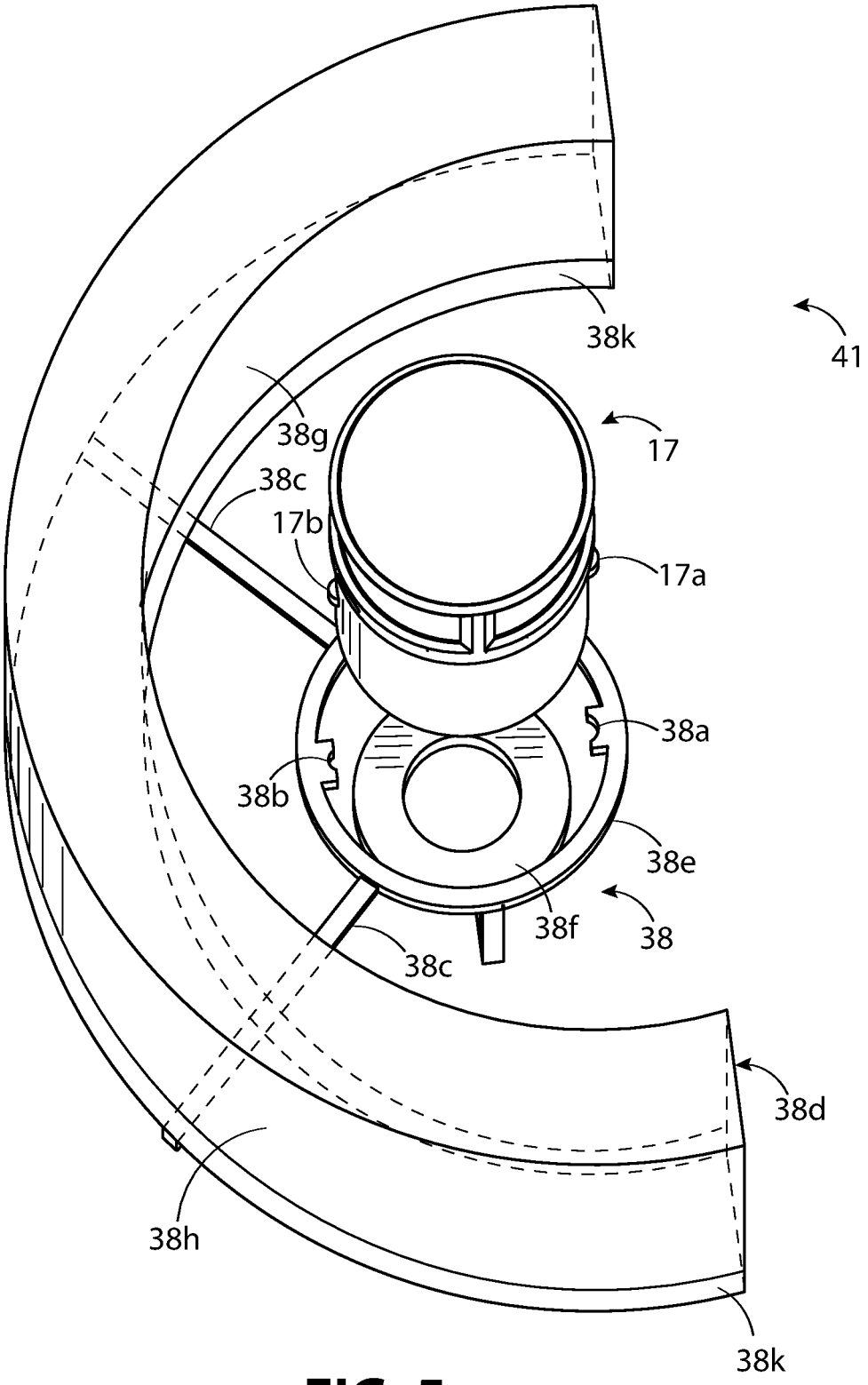
FIG. 5 illustrates the microphone sound-isolation baffle and the microphone of FIG. 3 in top and right perspective view.

Referring to FIGS. 3-5, the microphone sound-isolation baffle system 41 is illustrated as comprising the microphone sound-isolation baffle 38 combined with a microphone 17. The microphone 17 is illustrated with a first projected portion 17*a* projecting away from the microphone 17 and interfacing with a second projected portion 38*a* projecting inward on the microphone sound-isolation baffle 38. The microphone 17 is illustrated with a third projected portion 17*b* (FIG. 5) projecting away from the microphone 17 and interfacing with a fourth projected portion 38*b* (FIGS. 4 and 5) projecting inward on the microphone sound-isolation baffle 38. The first projected portion 17*a* and the third projected portion 17*b* (FIG. 5) are both illustrated as projecting outward from the microphone 17. The second projected portion 38*a* and the fourth projected portion 38*b* (FIGS. 4 and 5) are both shown projecting toward the microphone sound-isolation baffle 38 forming a groove or detent. This scheme could be reversed with the first projected portion 17*a* and the third projected portion 17*b* (FIG. 5) projecting inward form forming detents or grooves with the second projected portion 38*a* and the fourth projected portion 38*b* both projecting outward.

The first projected portion 17*a* can be positioned and shaped to be captively slidable with the second projected portion 38*a*. The third projected portion 17*b* and fourth projected portion can be positioned and shaped to captively slidable with the fourth projected portion 38*b*. As illustrated in FIG. 5, the first projected portion 17*a* can be complementary in shape with respect to the second projected portion 38*a*. The third projected portion 17*b* can be complementary shaped with respect to the fourth projected portion 38*b*. This combined with the position of these shapes creates the captive slidability. While the shape of these portions is shown as a circular sector, other arcuate or non-arcuate shapes can be utilized. For example, the shape can be a portion of a rectangle, triangle or ellipse. If only a single pair of shapes is used, then the detented shape can include an opening smaller than its inside cavity to facilitate captively slidability. For example, a closed rectangular cross-section with a grooved opening.

Figure 6:
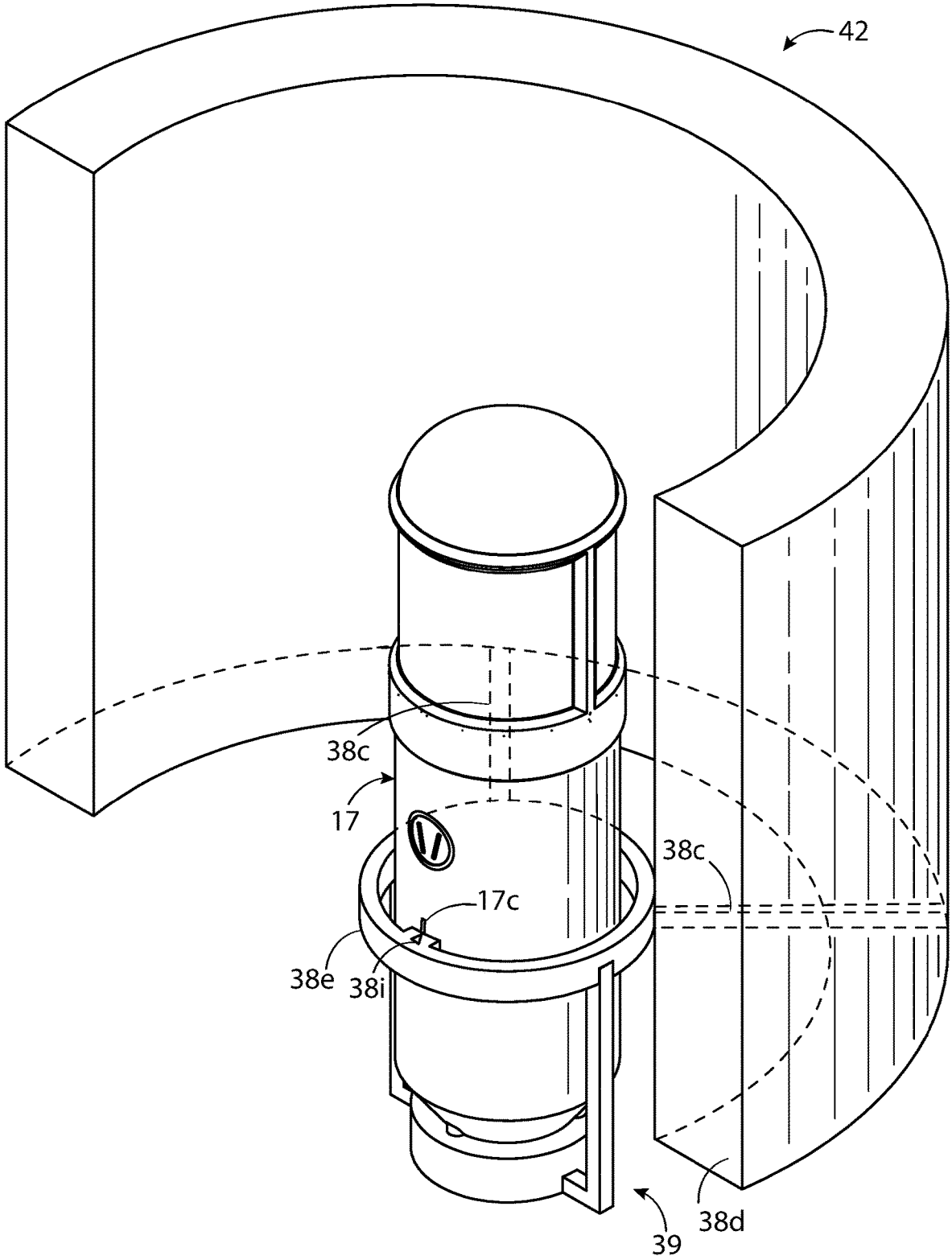
FIG. 6 illustrates a second example of a microphone sound-isolation baffle and a microphone in front and left perspective view.

The projected portion pairs can be different sizes from each other to key the microphone 17 and microphone sound-isolation baffle 38 to a particular predetermined rotational orientation. Referring to FIG. 5, the size of the first projected portion 17*a* and the second projected portion 38*a* differs from the third projected portion 17*b* and the fourth projected portion 38*b*. The microphone 17 is also held at a predetermined distance from the microphone sound-isolation baffle 38. In FIG. 5 this is accomplished by arms 38*c*, fixed in length, holding the acoustic baffle body 38*d* a fixed distance from the microphone mounting structure 38*e* with the microphone 17 resting vertically against a platform structure 38*f*. The arms 38*c* may be rigidly secured to acoustic baffle body via a frame structure 38*k* supporting the acoustic baffle body. The arms 38*c* can be rigidly secured by threaded fasteners, rivets, welding, adhesive or any structure that can secure the arms 38*c* to the acoustic baffle body 38*d* and sufficiently secure the microphone mounting structure to withstand day-to-day use of the microphone sound-isolation baffle system 41. FIGS. 3, 4, and 6 show the arms 38*c* and the bottom of acoustic baffle body 38*d* in hidden line view for additional clarity.

The frame structure 38*k*, and arms 38*c* as illustrated are one example of how the microphone mounting structure 38*e* and acoustic baffle body 38*d* a predetermined distance from each other. The inventor envisions other examples that are within the scope of the microphone sound-isolation baffle system 41. For example, the arms 38*c* instead of being fixed in length, could be telescoping or slidably variable in length, we fixed rigidly securable stops with indicia indicating a predetermined distance.

The acoustic baffle body 38*d* of FIGS. 3-5 includes sound absorbing material, for example an open-cell foam or covered fabric batting. This typically would be positioned on at least the inside-facing surface 38*g* (i.e. the surface facing the microphone 17). The outer-facing surface 38*h* (i.e., the surface facing away from the microphone 17) can optionally include acoustic reflective materials such as wood or aluminum to reflect acoustic energy away from the microphone sound-isolation baffle 38. In implementations where the outer-facing surface 38*h* is made of a reflective material, the arms 38*c* can be optionally to the outer-facing surface 38*h*.

Figure 7:
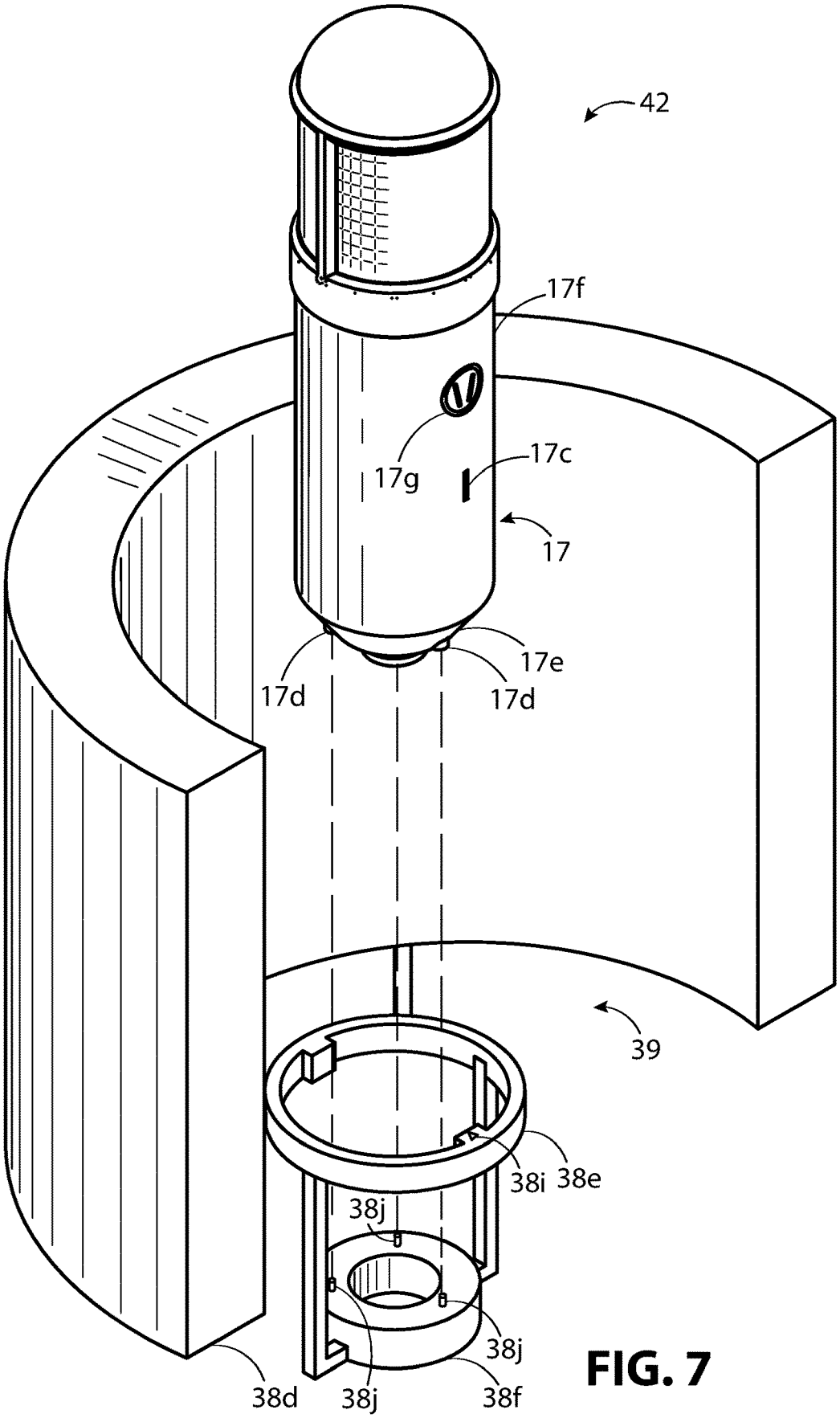
FIG. 7 illustrates the microphone sound-isolation baffle and the microphone of FIG. 6 in front, right, and exploded perspective view.

The microphone sound-isolation baffle 38 of FIGS. 3-5 sets the microphone sound-isolation baffle 38 to a predetermined rotational angle with respect to the microphone 17 using the keyed pairs of projected portions. FIGS. 6 and 7 illustrates a microphone sound-isolation system 42 that sets the microphone sound-isolation baffle 38 to a predetermined rotational angle with respect to the microphone 17 using indicia. Referring to FIGS. 6 and 7, instead of the projected portions of FIGS. 3-5, the microphone 17 includes a first indicia 17*c* that aligns to a second indicia 38*i* on the microphone mounting structure 38*e* of the microphone sound-isolation baffle 38. The first indicia 17*c* and the second indicia 38*i* are oriented so the microphone sound-isolation baffle 38 is aligned to a predetermined rotational angle with respect to the microphone 17.

Referring to FIG. 7, the microphone can be fixed to the predetermined rotational angle by alignment pins 38*j* projecting upward from the platform structure 38*f* and engaging two or more of the receptacles 17*d* that are sized and shaped to engage the alignment pins and hold the microphone 17 to a fixed orientation with respect to the microphone sound-isolation baffle 38. The receptacles 17*d* can be fastener heads for holding the microphone bottom portion 17*e* to the microphone body 17*f*. The alignment pins 38*j* can be complementary in shape to the fastener heads. For example, if the fastener heads were hexagonally shaped, the alignment pins 38*j* could be hexagonally shaped. It is also possible to fix the microphone 17 to the predetermined angle with the microphone sound-isolation baffle 38 by having alignment pins project out of the microphone bottom portion 17*e* and aligned with receptacles in or on the platform structure 38*f*.

The logo badge 17*g* can optionally be used as the first indicia 17*c* by adjusting the position of the logo badge 17*g* or the height of the microphone mounting structure 38*e* so that they are aligned to each other.

As discussed, the microphone modeling system 10 of FIG. 1 and the microphone modeling system 11 of FIG. 2 can be used with a modeled reference microphone or the modeled reference microphone in combination with a modeled microphone sound-isolation baffle. In FIG. 1 and FIG. 2, the user can indicate the presence or absence of the microphone sound-isolation baffle with the microphone sound-isolation baffle on/off user control 23. The microphone sound-isolation baffle on/off user control 23 can be located on the microphone 17 or can be located on another user interface device, such as the graphical user interface 47 of FIG. 9. The inventor envisions that it may be desirable for automatic detection of the presence of the microphone sound-isolation baffle. FIG. 8 illustrates a microphone modeling system 43 similar to the microphone modeling system 10 of FIG. 1 with the microphone capsule, on-axis microphone model filter 15, on-axis microphone model coefficient lookup table 19, microphone type user control 20, microphone sound-isolation baffle inverse filter 21, and microphone sound-isolation baffle inverse coefficients 22, except the microphone sound-isolation baffle on/off user control 23 of FIG. 1 is replaced with a microphone sound-isolation baffle detection circuit 44. The detection circuit controls the microphone sound-isolation baffle inverse coefficients 22 by automatically turning the microphone sound-isolation baffle inverse filter 21 on and off. The presence or absence of the microphone sound-isolation baffle can be indicated on the microphone, for example by a light emitting diode (LED) and/or on a graphical user interface. For example, in FIG. 9, the baffle on indicator 48 within the graphical user interface 47.

In FIG. 8, the microphone sound-isolation baffle detection circuit 44 includes a magnet 45 and a hall-effect sensor 46. The magnet 45 could be positioned in either the microphone or the microphone sound-isolation baffle with the hall-effect sensor 46 and associated circuitry positioned within the opposite element. The magnet 45 and hall-effect sensor 46 can be positioned anywhere on the opposite element so that when the microphone sound-isolation baffle is present detection of the microphone sound-isolation baffle occurs. For example, in FIG. 3 the magnet 45 of FIG. 8 could be positioned within the microphone sound-isolation baffle 38 proximate to the second projected portion 38*a* and the hall-effect sensor 46 of FIG. 8 could be positioned within the microphone proximate to the first indicia 17*c*. Similarly, in FIG. 6, the magnet 45 of FIG. 8 could be positioned within the microphone sound-isolation baffle 38 proximate to the second indicia 38*i* and the hall-effect sensor 46 of FIG. 8 could be positioned within the microphone 17 proximate to the first indicia 17*c*. These configurations allow the microphone sound-isolation baffle 38 to remain electrically passive (i.e., without any electrical circuitry) which may be desirable. Referring to FIGS. 3, 6, and 8, these examples are not exhaustive and not meant to be limiting. The magnet 45 (FIG. 8) and the hall-effect sensor 46 can be mounted anywhere on opposite structures, i.e., one on the microphone 17 (FIGS. 3 and 6) and the other on the microphone sound-isolation baffle 38 (FIGS. 3 and 6), for detection to occur.

While FIG. 8 shows the microphone sound-isolation baffle detection circuit 44 as a magnet paired with a hall-effect sensor 46, the microphone sound-isolation baffle detection circuit is not limited to this. For example, the microphone sound-isolation baffle detection circuit 44 can be an optical detector paired with an infrared LED or a radio frequency identification (RFID) transmitter paired with an RFID detector. RFID detection can be useful if more than one microphone sound-isolation baffle is modeled. Each type of microphone sound-isolation baffle can be given its own identifier so the system can detect and automatically load the coefficients corresponding to the microphone sound-isolation baffle type in use.

FIGS. 3-5 and FIGS. 6 and 7 illustrate two examples of microphone sound-isolation baffle 38, 39, respectively. The inventor envisions a range of microphone sound-isolation systems where the microphone and the removable microphone sound-isolation baffle is settable to a predetermined distance and a predetermined rotational angle with respect to the microphone. For example, FIGS. 10-17 and FIG. 18 illustrate an alternative style of microphone sound-isolation baffle 50, 53, respectively. Referring to FIGS. 10-17, and FIGS. 18 and 19, the microphone sound-isolation baffle 50, 53 is mounted over an upper portion of the microphone 18, 58 and surrounds the microphone 18, 58. The microphone sound-isolation baffle 50, 53 is typically made of an open-cell foam material such as open-cell polyurethane. Referring to FIGS. 10-17, the microphone sound-isolation baffle 50 includes a first opening 50*a* to expose the front microphone grill 18*a* (FIGS. 10, 12, 13, and 16). The front microphone grill 18*a* protects the microphone capsule or capsules.

Figure 12:
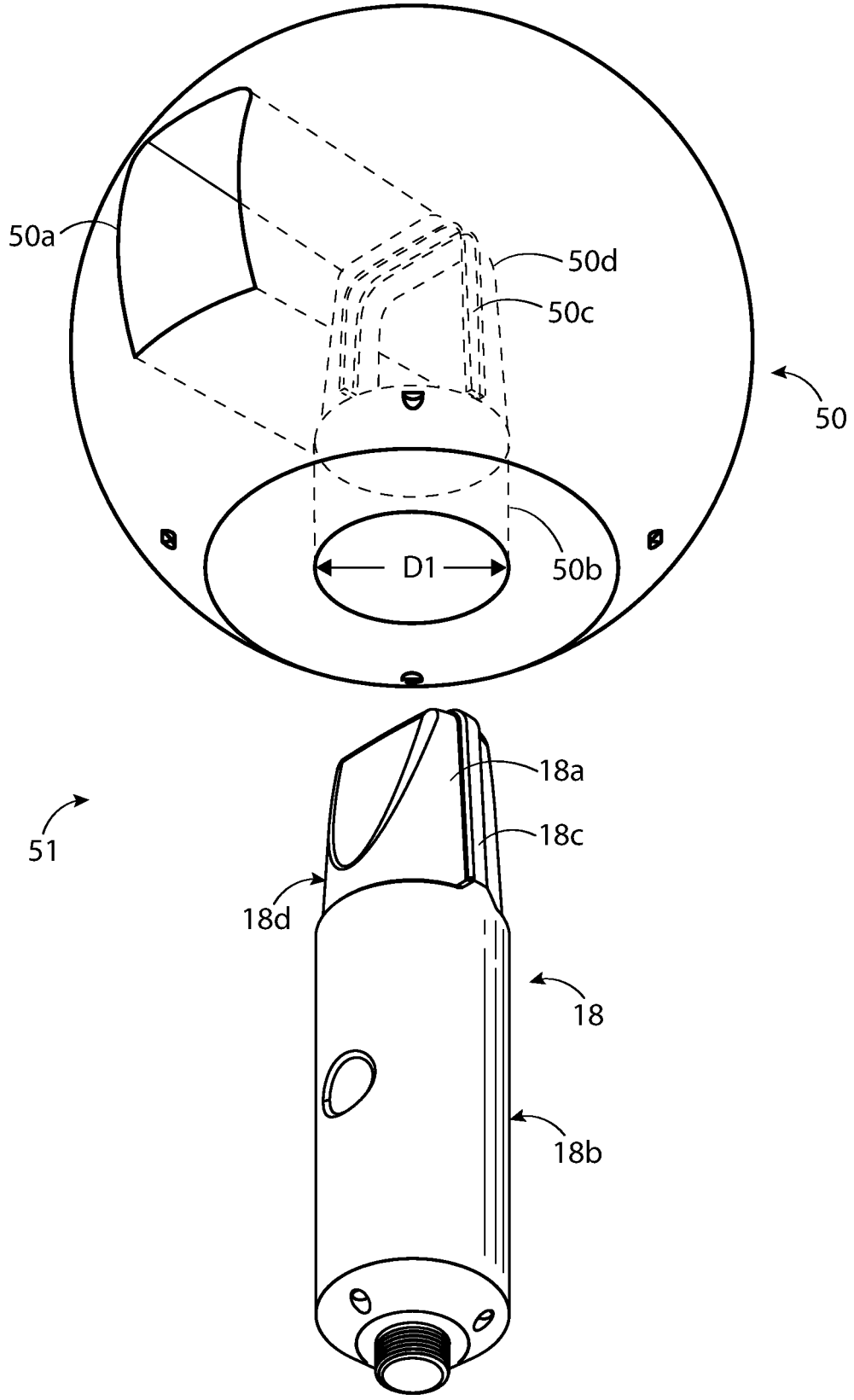
FIG. 12 illustrates the microphone sound-isolation baffle and microphone of FIG. 10 in front, left, and exploded perspective view.
Figure 13:
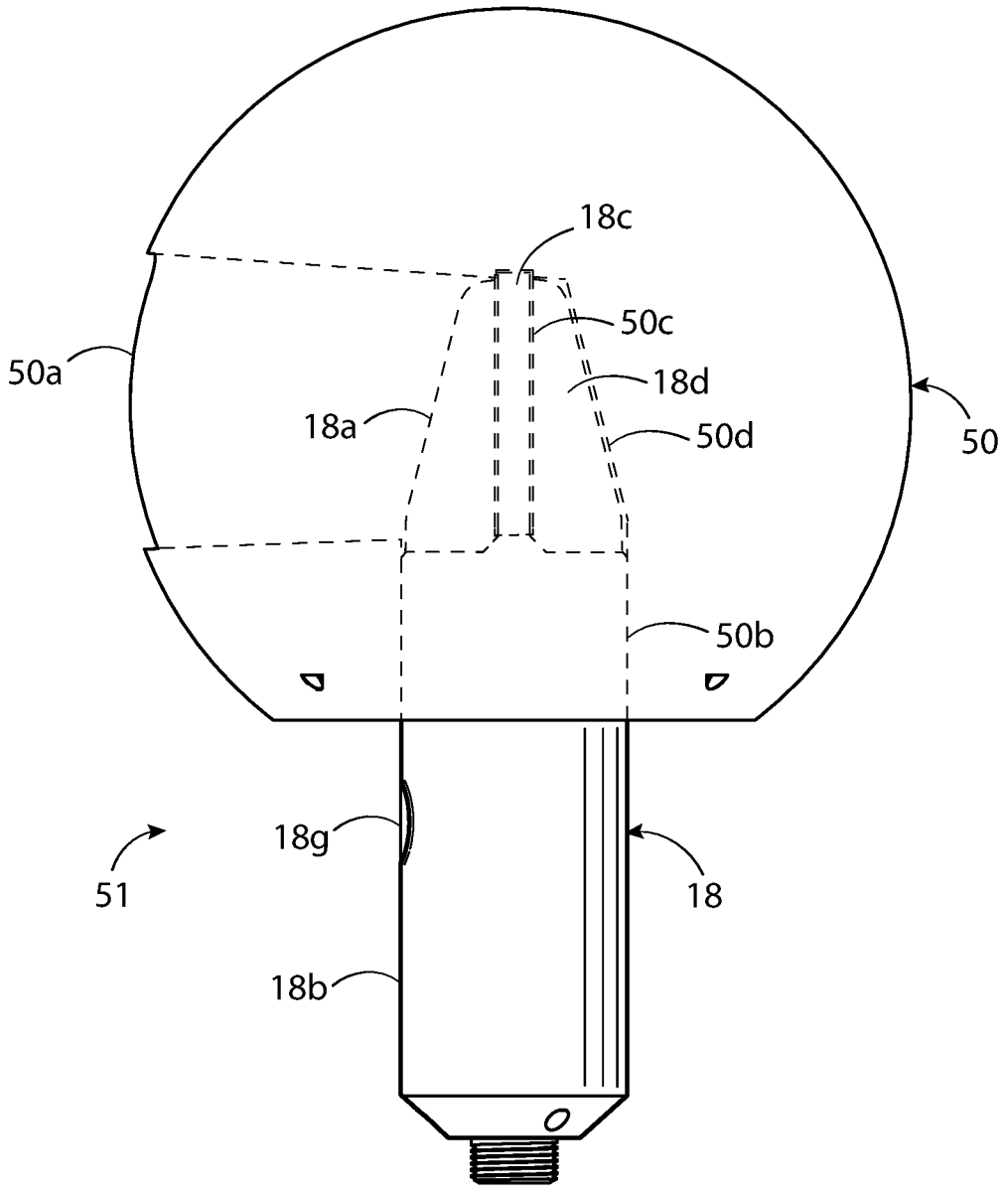
FIG. 13 illustrates the microphone sound-isolation baffle and microphone of FIG. 10 in right side view hidden lines indicated by dashed lines.
Figure 16:
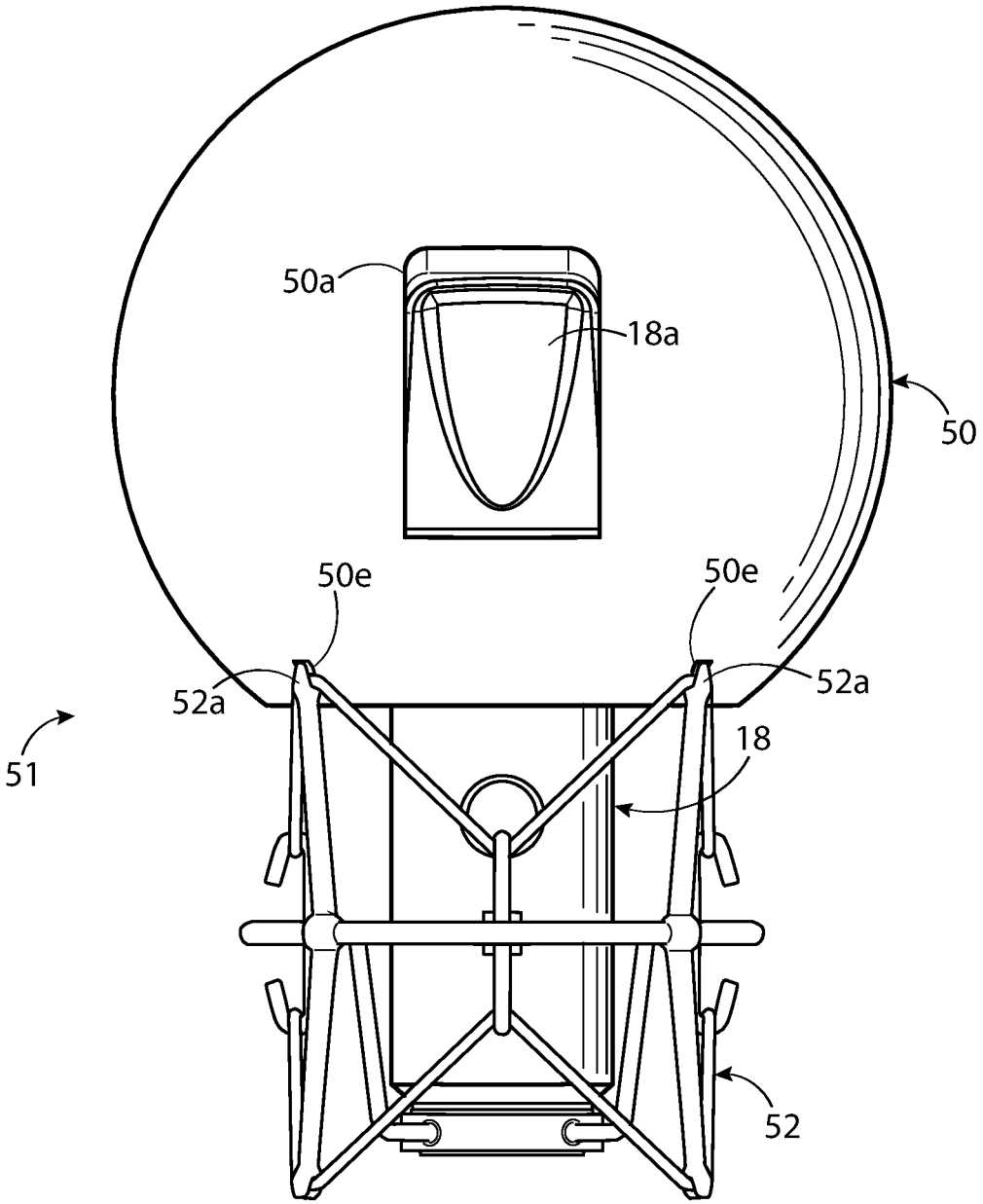
FIG. 16 illustrates the microphone sound-isolation baffle and microphone of FIG. 10 with a microphone shock mount in front view.
Figure 17:
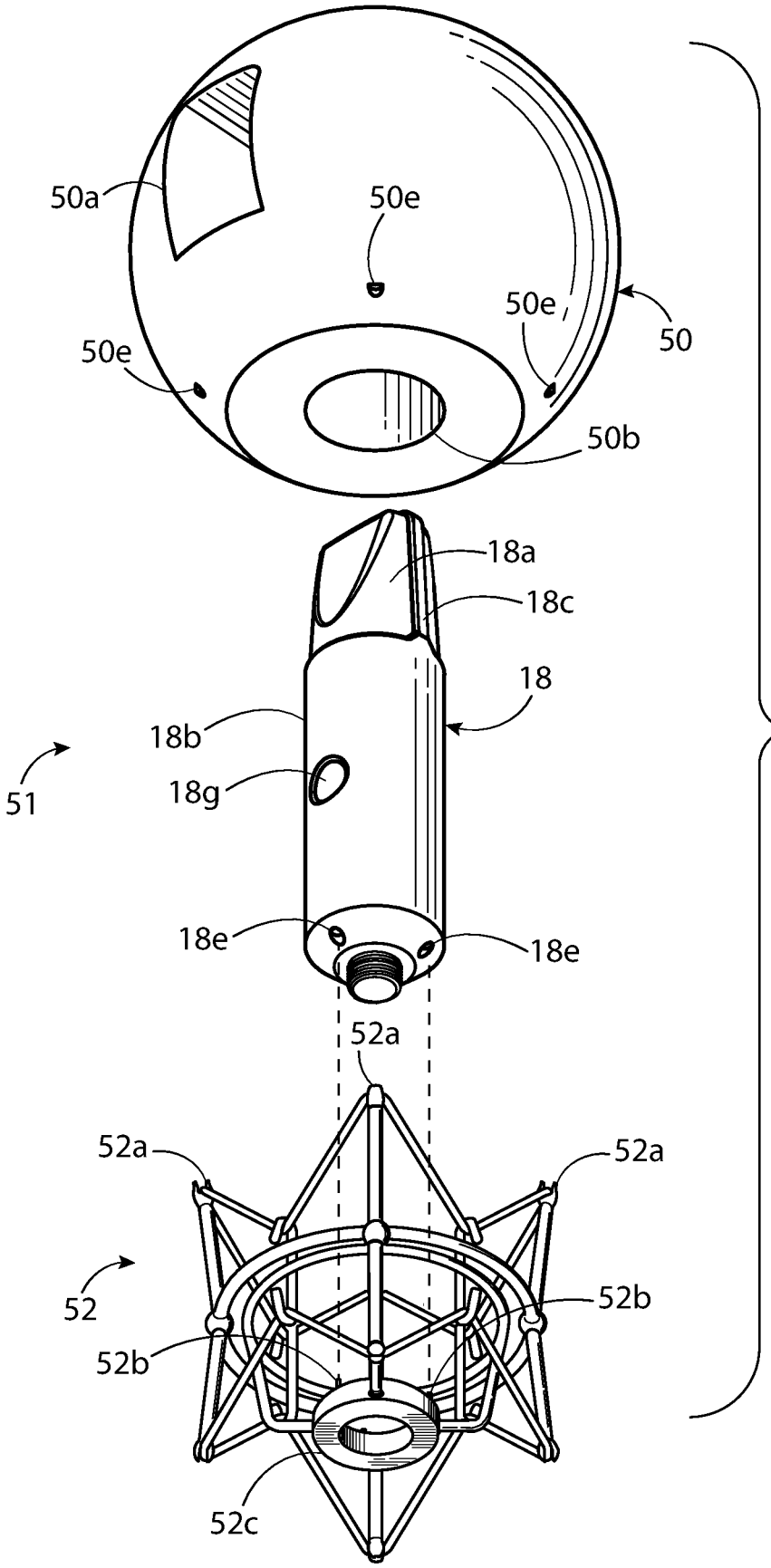
FIG. 17 illustrates the microphone sound-isolation baffle, microphone, and shock mount of FIG. 16 in bottom, right, and exploded perspective view.

Referring to FIGS. 12, 13, and 17, the microphone 18 slides into the microphone sound-isolation baffle 50 through a second opening 50*b*. The second opening 50*b* can be the cross-sectional shape of the microphone body 18*b*. For example, the microphone 18 is illustrated with a circular cross-section with second opening also illustrated with a circular cross-section of the same diameter to maintain the microphone 18 a predetermined fixed distance from the microphone sound-isolation baffle 50. Unlike microphone isolation filters that surround the microphone in the prior art designed to accommodate a range of microphone sizes, the microphone sound-isolation baffle 50 of FIGS. 10-17 can accommodate a specific reference microphone with known size and dimensions. For example, referring to FIG. 12, by having an opening, such as the second opening 50*b* having a diameter D1 match the size of the reference microphone, such as microphone 18 also with a diameter D1, the microphone sound-isolation baffle 50 can be held a predetermined distance from the microphone 18. The second opening 50*b* could have a diameter larger than the diameter than the microphone 18 and include a sleeve or spacer to hold the microphone 18 a fixed predetermined distance from the microphone sound-isolation baffle 50.

Figure 14:
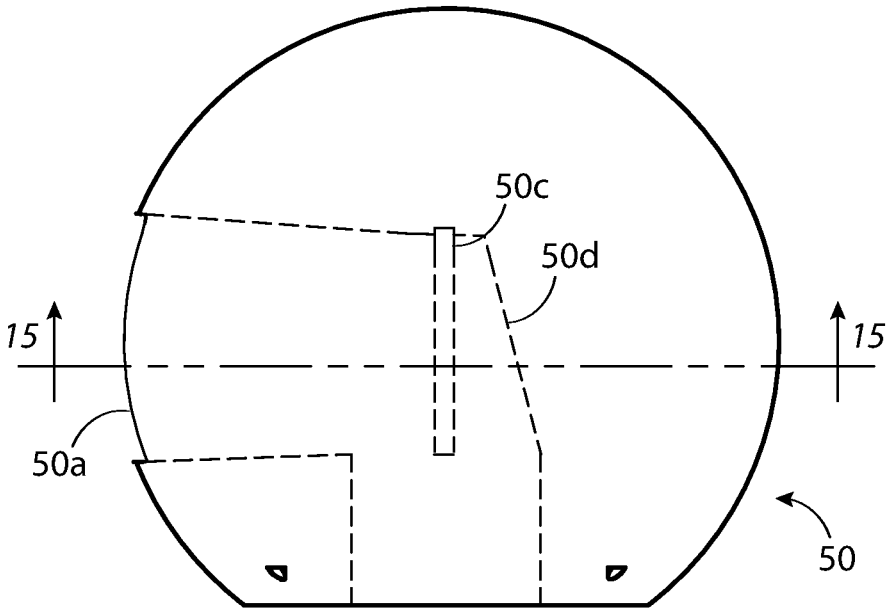
FIG. 14 illustrates the microphone sound-isolation baffle of FIG. 13 in right side view hidden lines indicated by dashed lines.
Figure 15:
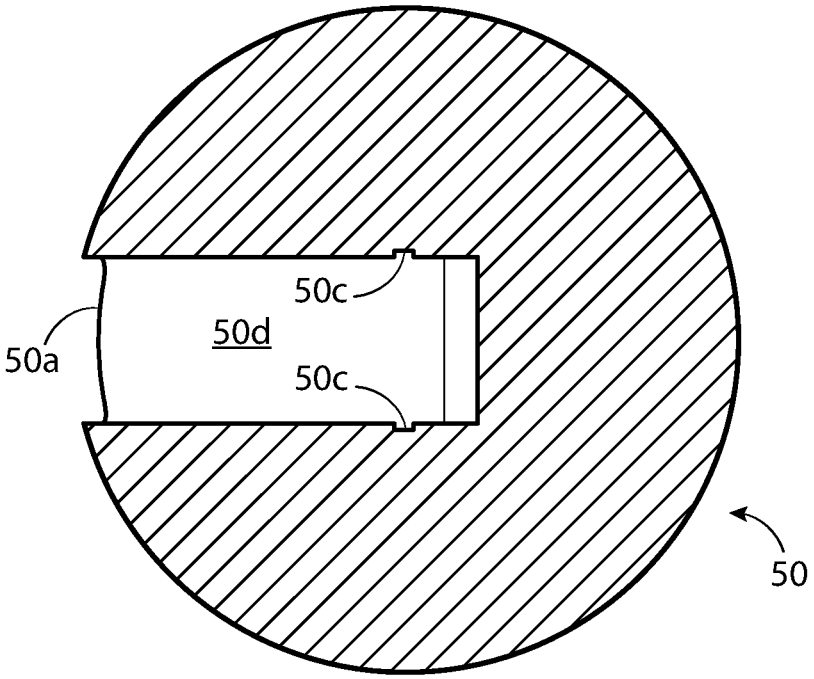
FIG. 15 illustrates a section view taken along section lines 15-15 of FIG. 14.

FIGS. 12-15 show the internal structure of the microphone sound-isolation baffle 50. FIGS. 12-14 should the internal structure with dashed lines to indicate hidden structure within the microphone sound-isolation baffle. FIG. 15 is a section view of FIG. 14 taken along section lines 15-15. Referring to FIGS. 12 and 13 the microphone can include a first projected portion 18*c* projecting away from the surface of the microphone 18. Here, the projecting is the head basket holding bracket projecting away from the head basket portion 18*d* of the microphone 18. Referring to FIGS. 12-15, the microphone sound-isolation baffle 50 includes a second projected portion 50*c*, in the form of a groove, detented into the surface of the cavity 50*d* between the first opening 50*a* and the second opening 50*b*. Referring to FIGS. 12 and 13 the first projected portion 18*c* and the second projected portion 50*c* are approximately complementary in shape so that when the first projected portion 18*c* engages the second projected portion 50*c*, the first projected portion 18*c* and the second projected portion 50*c* together fix the microphone 18 to the predetermined rotational angle with respect to the microphone sound-isolation baffle 50. Referring to FIG. 18, the microphone sound-isolation baffle 50 could be extended downward to cover the microphone logo 18*g*. Alternatively the microphone logo 18*g* could be moved upward. In either case, the microphone logo 18*g* could become the first projected portion. A second projected portion, complementary shaped with the microphone logo 18*g*, could engage the microphone logo 18*g* and fix the microphone 18 to a predetermined rotational angle with respect to the microphone sound-isolation baffle 50.

Referring to FIGS. 12-15, first opening 50*a* is illustrated as having a rectangular horizontal cross-section (FIG. 15) and a pyramidal vertical cross-section (FIGS. 12-14). This shape attempts to maximize on-axis sound while attempting to minimize unwanted room noise. As an alternative example, the first opening 50*a* could be a frusto-conically shaped. The inventor conceives a wide range of microphone sound-isolation baffles that can hold the microphone 18 a predetermined fixed distance from the microphone sound-isolation baffle 50 and hold the microphone 18 to a predetermined rotational angle with respect to the microphone sound-isolation baffle 50. These are typically independent of the outside shape of the microphone sound-isolation baffle 50 or the shape of first opening 50*a*. The shape of the first opening 50*a* and the outside shape of the microphone sound-isolation baffle 50 is not relevant to setting or securing the microphone 18 a predetermined fixed distance from the microphone sound-isolation baffle 50 and hold the microphone 18 to a predetermined rotational angle with respect to the microphone sound-isolation baffle 50.

Referring to FIG. 12, a variation of the microphone sound-isolation baffle 50, that holds the microphone 18 a predetermined fixed distance from the microphone sound-isolation baffle 50 and hold the microphone 18 to a predetermined rotational angle with respect to the microphone sound-isolation baffle 50, could include a sleeve shaped to fit the contour of the microphone body 18*b* and the head basket portion 18*d*. The sleeve could include a groove surface similar to the second projected portion 50*c* that slidably engages the first projected portion 18*c* and holds the microphone 18 to a fixed rotational angle with respect to the microphone sound-isolation baffle 50. The microphone body 18*b* could include the first projected portion 18*c* disposed length-wise either as a grooved surface or an outwardly projected surface along the microphone body 18*b*. The second projected portion 50*c* could be disposed along the length of the inside surface of the second opening 50*b* and be complementary to the first projected portion 18*c*. For example, if the first projected portion 18*c* were a groove, the second projected portion 50*c* would be outwardly projected and vice versa. The first projected portion could be a pair of projected portions positioned on opposing sides of the microphone body 18*b* with the second projected portion 50*c* being positioned on opposing sides of the surface of the second opening 50*b*. The variations described in this paragraph could be implemented with the second projected portion 50*c* projecting inward or outward from a sleeve within the second opening 50*b*.

The microphone sound-isolation system 51 described for FIGS. 10-13 can also be implemented with a microphone shock mount 52 as illustrated in FIGS. 16 and 17. Referring to FIGS. 16 and 17, the microphone sound-isolation baffle 50 includes apertures 50*e* that are sized and shaped to receive the post caps 52*a* of the microphone shock mount 52. The combination of the post caps 52*a* and the apertures 50*e* holds the microphone sound-isolation baffle 50 a fixed pre-set distance with respect to the microphone shock mount 52. Referring to FIG. 17, the microphone 18 can be held in a pre-set distance from the microphone shock mount 52 by alignment pins 52*b* projecting away from the base 52*c* of the microphone shock mount 52 that engage receptacles 18*e* in the microphone 18. This is similar to the arrangement described for FIG. 7. Similar to as described for FIG. 7, the receptacles and alignment pins could be swapped, with the receptacles could be mounted in or on the base 52*c* of the microphone shock mount 52 and the alignment pins could be mounted on the microphone.

Referring back to FIGS. 16 and 17, with the microphone sound-isolation baffle 50 as described with various variations for FIGS. 10-15, the combination of the microphone 18, first projected portion 18*c* (FIG. 17), second projected portion 50*c* (not shown, but shown and described in FIG. 12), the apertures 50*e* and post caps 52*a*, alignment pins 52*b* and receptacles 18*e* (FIG. 17), positions the microphone a predetermined fixed distance and predetermined fixed angle of rotation with respect to microphone sound-isolation baffle 50.

Figure 20:
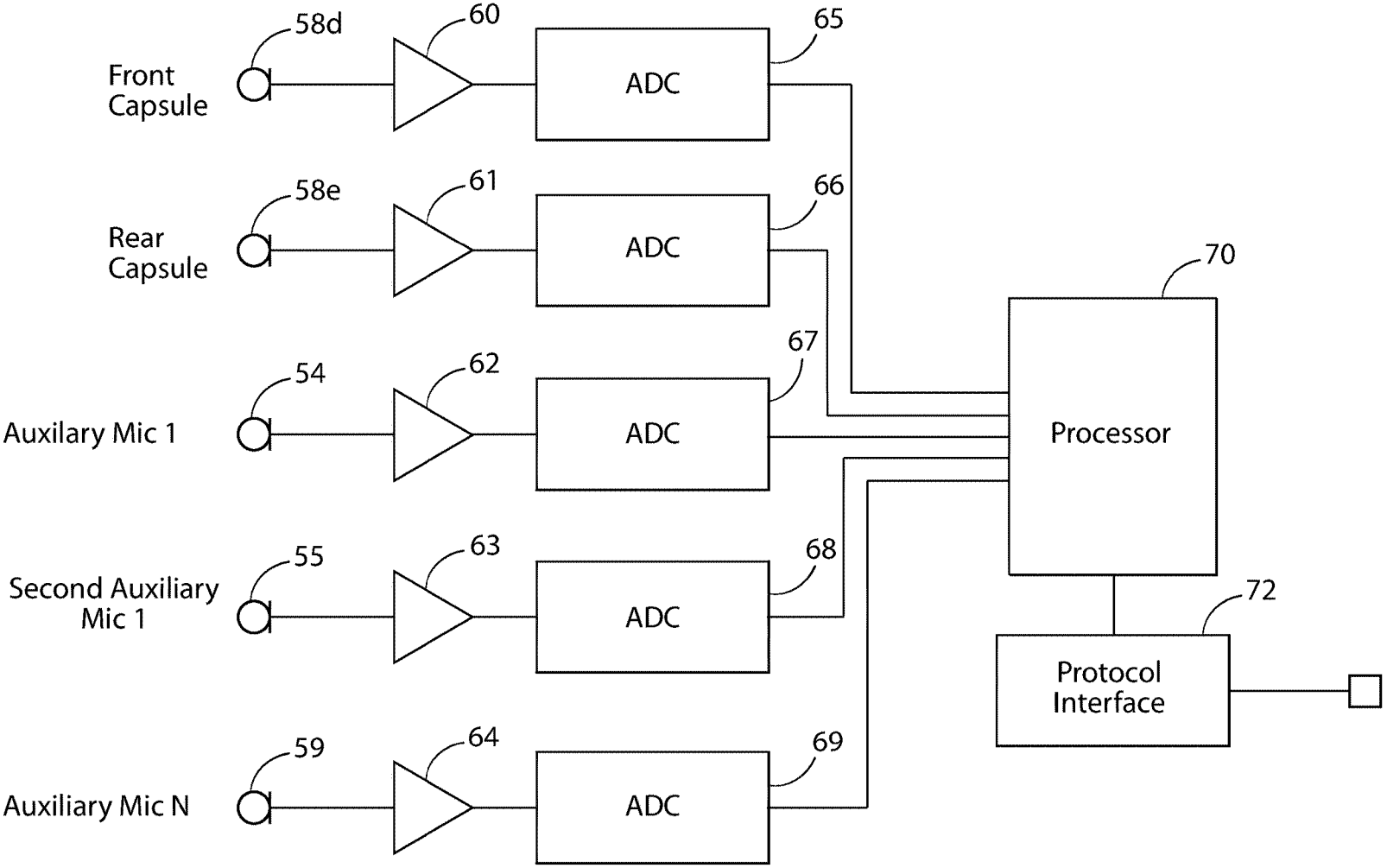
FIG. 20 illustrates a typical circuit block diagram for FIGS. 18 and 19.
Figure 21:
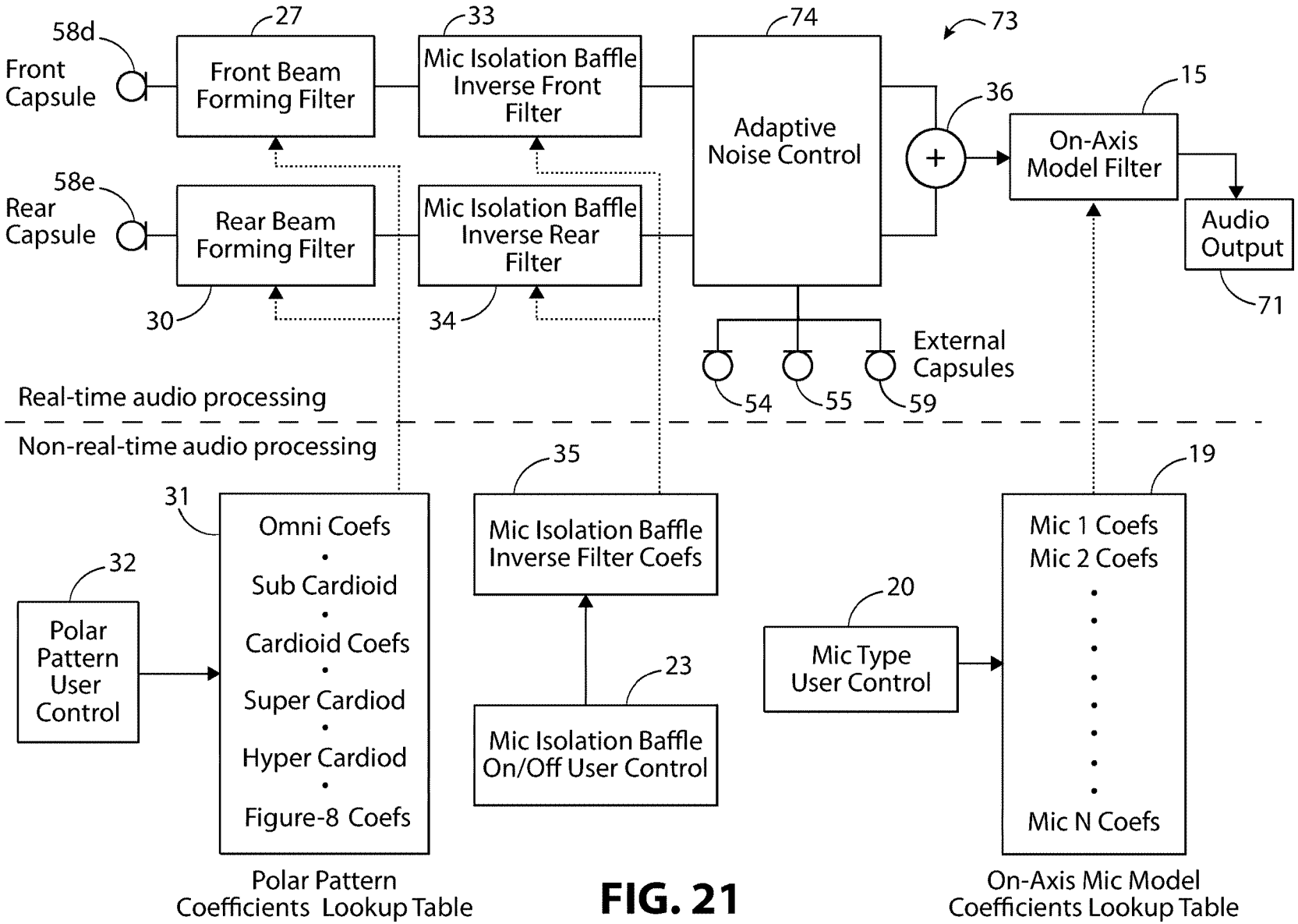
FIG. 21 illustrates a block diagram of a microphone modeling system capable of compensating for a microphone sound-isolation baffle and canceling external noise using an external microphone or microphones for noise sampling.

One reason for using a microphone sound-isolation baffle such as the microphone sound-isolation baffle 38 of FIGS. 3-5, the microphone sound-isolation baffle 39 of FIGS. 6 and 7, or the microphone sound-isolation baffle 50 of FIGS. 10-17 is to isolate the microphone from ambient noise and the effects of room acoustics. With this in mind, the inventor reasoned that he could use the microphone sound-isolation baffle 38, 39, 50 and microphone modeling in combination with active noise cancelation to further reduce the effect of ambient noise and room acoustics. FIGS. 18-21 show a system that accomplishes this. FIG. 18 illustrates a microphone sound-isolation baffle 53, a microphone 58, and external or auxiliary microphones 54, 55 mounted on the microphone sound-isolation baffle for noise cancelation. FIG. 19 illustrates the microphone sound-isolation baffle 53, microphone 58, and auxiliary microphones 54, 55 mounted into the microphone body 58*b* below the microphone sound-isolation baffle 53. FIG. 20 illustrates a typical circuit block diagram for FIGS. 18 and 19. FIG. 21 illustrates a block diagram of a microphone modeling system capable of compensating for a microphone sound-isolation baffle and canceling external noise using external microphone for noise sampling. Referring to FIG. 18 the microphone sound-isolation baffle 53 is similar to the microphone sound-isolation baffle 50 of FIGS. 10-17, and with the features and structure previously described except for channels 53*a*, 53*b* that are sized and shaped to receive auxiliary microphones 54, 55 and channel 53*d* that route the cable 56 of the auxiliary microphones 54, 55 through the microphone sound-isolation baffle 53. The exterior mechanical structure of the microphone 58 is similar to the exterior mechanical structure of microphone 18 with a first projected portion 58*c* engaging a second projected portion 53*c* of the microphone sound-isolation baffle 53 in a similar manner as described for microphone 18 and microphone sound-isolation baffle 50 for FIGS. 12 and 13.

In FIG. 18, the auxiliary microphones 54, 55 are positioned a predetermined distance apart and placed at predetermined positions on the microphone sound-isolation baffle 53 body. In FIG. 18, the auxiliary microphones 54, 55 are facing rearward 180° horizontally off-axis (i.e. opposite the front face of the microphone) with auxiliary microphone 54 pointing approximately 20° degrees below the horizon and auxiliary microphone 55 pointing approximately 40° degrees above the horizon. This is a possible arrangement and not meant to be limiting. Other arrangements that can sample room noise are within the scope of the inventive concept. The cable 56 of the auxiliary microphones 54, 55 terminates in a signal connector 57 that that mates with a signal connector 58*a* on the microphone body 58*b*. The signal connectors 57, 58*a* are illustrated as a mini-XLR male and a mini-XLR female connector, respectively. Signal connectors 57, 58*a* can be can be any removable signal connector type suitable for passing microphone signal level audio frequency signals.

Referring to FIG. 19, the auxiliary microphones 54, 55 can alternatively be placed on the microphone body 58*b* so positioned, so they are unobstructed by the microphone sound-isolation baffle 53. The auxiliary microphones 54, 55 can be wired directly into the microphone 58 or directly onto a circuit board within the microphone 58 thereby avoiding external cables or signal connectors.

FIG. 20 illustrates a typical circuit block diagram for FIGS. 18 and 19. Referring to FIG. 20, the microphone 58 is shown including a front microphone capsule 58*d* and a rear microphone capsule 58*e*. These are typically positioned back-to-back with the front capsule facing forward toward the front of the microphone 58 and the rear microphone capsule 58*e* facing rearward toward the back of the microphone 58. In addition to the auxiliary microphones 54, 55, additional auxiliary microphones can be placed within the microphone sound-isolation baffle 53 in a similar manner. Auxiliary microphone 59 in FIG. 20 represents one or more additional auxiliary microphones. The output signals from the front microphone capsule 58*d*, rear microphone capsule 58*e*, and auxiliary microphones 54, 55, 59 typically feed preamplifiers, such as preamplifier 60, 61, 62, 63, 64 respectively. The output of the preamplifiers 60, 61, 62, 63, 64 will feed ADCs such as ADCs 65, 66, 67, 68, 69 respectively. The output of the ADCs 65, 66, 67, 68, 69 will feed a processor 70. The ADCs may be discrete units, they may be integrated into one integrated circuit, a single multiplexed ADC, or can be within the processor 70. The preamplifiers can be discrete circuits, integrated circuit preamplifiers as single or multiple units, or can be integrated with an ADC or ADCs. The preamplifiers can be any preamplifier capable of amplifying signals from front microphone capsule 58*d*, rear microphone capsule 58*e*, and auxiliary microphones 54, 55, 59 to a level suitable for the ADC and at a signal quality level suitable for ambient noise sampling and ambient noise cancelation. The ADCs 65, 66, 67, 68, 69 can be any ADC capable of converting analog audio signals into digital format with signal distortion and noise levels low enough for the ambient noise sampling and ambient noise cancelation by the processor 70. The processor 70 can be a microprocessor, microcontroller, field programmable gate array (FPGA), a digital signal processor (DSP), or any processing device capable of performing the digital signal processing functions described for FIGS. 18-20. The audio output 71 in FIGS. 20 and 21 feeds a digital protocol interface 72. The digital protocol interface 72 can be wireless, for example, 802.11, or wired, such as USB, Firewire, Thunderbolt, Ethernet, or AES/EBU.

The microphone 58 of FIGS. 18 and 19 can include the entire circuit of FIG. 20 and include the microphone modeling system 73 of FIG. 21. The microphone 58 can convert the analog signals from the front microphone capsule 58*d*, the rear microphone capsule 58*e*, and the auxiliary microphones 54, 55 into digital form and pass a digital signal to a computer, mobile device, or standalone audio processing device to implement the microphone modeling system 73 of FIG. 21. The microphone 58 can alternatively not include digital circuitry and simply pass through the analog signals from the front microphone capsule 58*d*, the rear microphone capsule 58*e*, and the auxiliary microphones 54, 55.

FIG. 21, illustrates a block diagram of a microphone modeling system 73 with two microphone capsules similar to the microphone modeling system 11 of FIG. 2 except for the addition of an adaptive noise control filter 74 between the first microphone sound-isolation baffle inverse filter 33, second microphone sound-isolation baffle inverse filter 34, and the on-axis microphone model filter 15. The microphone modeling system 73 of FIG. 21 is capable of compensating for both the on-axis and off-axis response of the microphone baffle as well as canceling additional unwanted contributions of room noise and room ambience. A digitized version of the signal from a front microphone capsule 58*d* feeds a first beamforming filter 27. A digitized version of the signal from the rear microphone capsule 58*e* feeds a second beamforming filter 30. The first beamforming filter 27 is shown in FIG. 21 as a front beamforming filter because it is being feed by a forward-facing microphone capsule, front microphone capsule 58*d*. The second beamforming filter 30 is shown as a rear beamforming filter because it is being feed from a digitized signal from a rearward facing microphone capsule, rear microphone capsule 58*e*. Typical conversion circuitry to create the digitized signals are discussed in FIG. 17.

The first beamforming filter 27, the second beamforming filter 30, polar pattern coefficients lookup table 31, polar pattern user control 32, first microphone sound-isolation baffle inverse filter 33, second microphone sound-isolation baffle inverse filter 34, microphone sound-isolation baffle inverse coefficients 35, and microphone sound-isolation baffle on/off user control 23 all function and interact as previously described for FIG. 2. The first microphone sound-isolation baffle inverse filter 33 is shown as microphone sound-isolation baffle inverse front filter because its signal originates from the front microphone capsule 58*d* by way of the first beamforming filter 27. The second microphone sound-isolation baffle inverse filter 34 is shown as microphone sound-isolation baffle inverse rear filter because its signal originates from the rear microphone capsule 58*e* by way of the second beamforming filter 30.

The output signal from the first microphone sound-isolation baffle inverse filter 33 and the second microphone sound-isolation baffle inverse filter 34 feed the adaptive noise control filter 74. The adaptive noise control filter 74 receives digitized signals from the auxiliary microphones such as auxiliary microphones 54, 55 in FIGS. 18 and 19 or auxiliary microphones 54, 55, 59 in FIG. 20. The signals can be digitized, for example, in a manner described for FIG. 20. The adaptive noise control filter 74 uses an adaptive noise canceling algorithm to cancel from the output signals of first microphone sound-isolation baffle inverse filter 33 and second microphone sound-isolation baffle inverse filter 34 first beamforming filter any signal in common with the auxiliary microphones 54, 55, 59. Typically, a least means square (LMS) or normalized least means square (NMLS) filter algorithm. Any adaptive noise cancelation filter type or algorithms can be used that are suitable for real-time processing of professional digital audio signals. Professional digital audio typically runs at sample rates from 44.1 kHz to 196 kHz.

The resulting front and rear outputs of the adaptive noise control filter 74 are summed by a summing element 36. The summed output feeds the on-axis microphone model filter 15. As described for FIGS. 1 and 2, the on-axis microphone model coefficient lookup table 19 takes the known frequency response of the microphone 58 and maps coefficients on to the on-axis microphone model filter 15 to create a frequency response that emulates the on-axis frequency response of a target microphone. The user can select what target microphone they wish to emulate using the microphone type user control 20 as described. The resulting audio output 71 compensates for both the on-axis and off-axis response of a modeled microphone isolation filter.

Figure 22A:
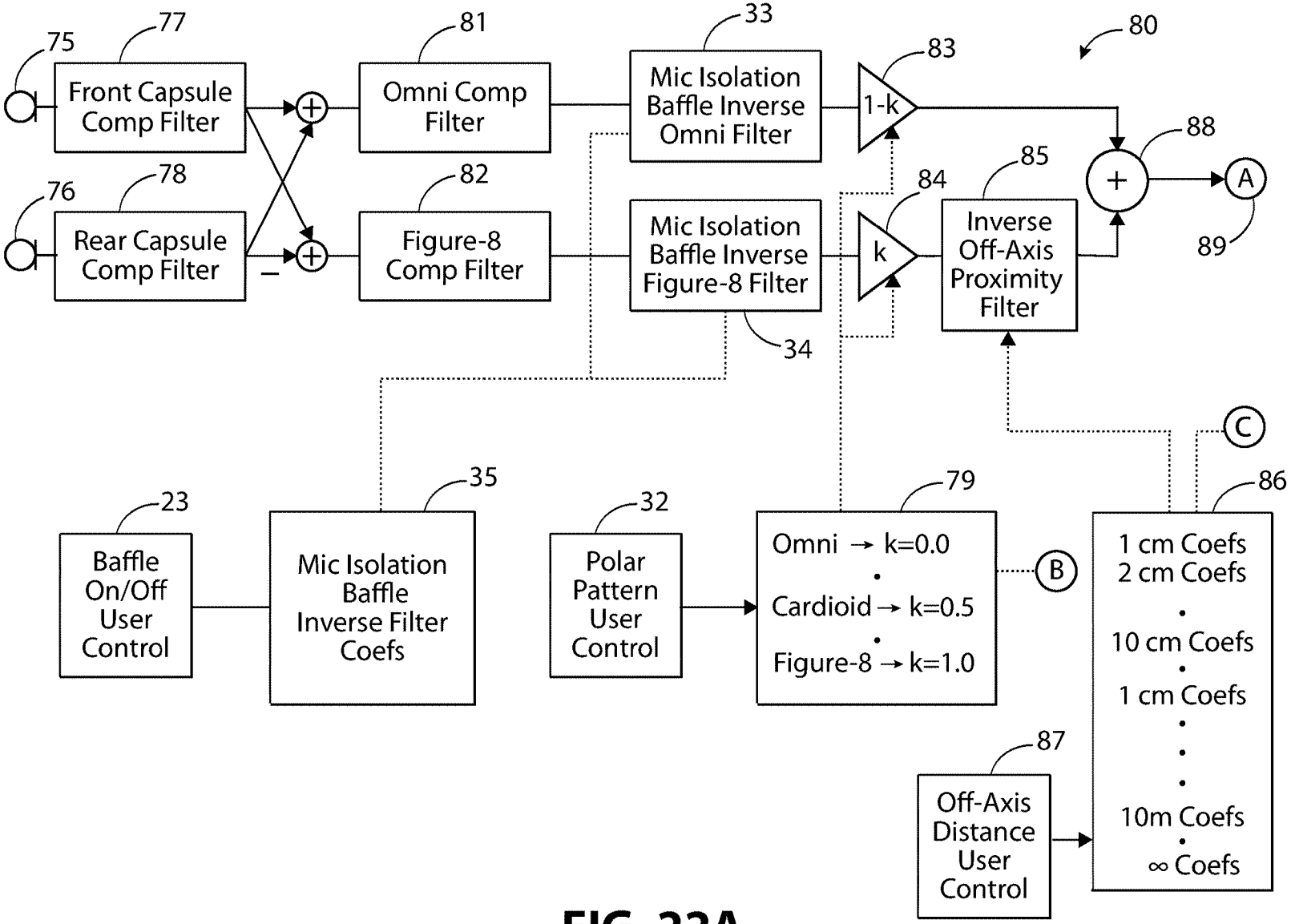
FIG. 22A illustrates a first portion of a block diagram of a microphone modeling system capable of compensating for a microphone sound-isolation baffle and proximity effect.
Figure 22B:
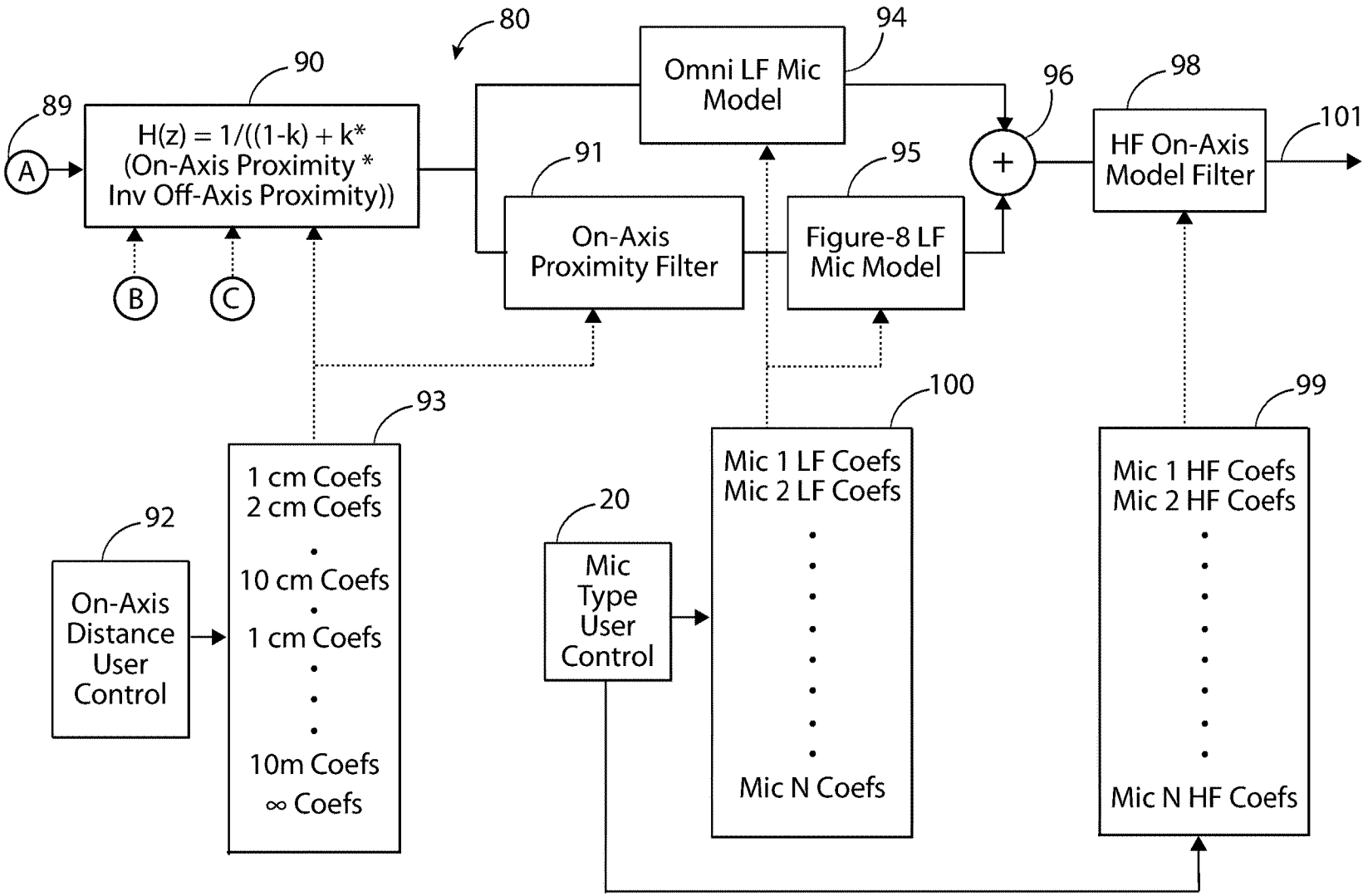
FIG. 22B illustrates a second portion of the block diagram of FIG. 22A.
Figure 23A:
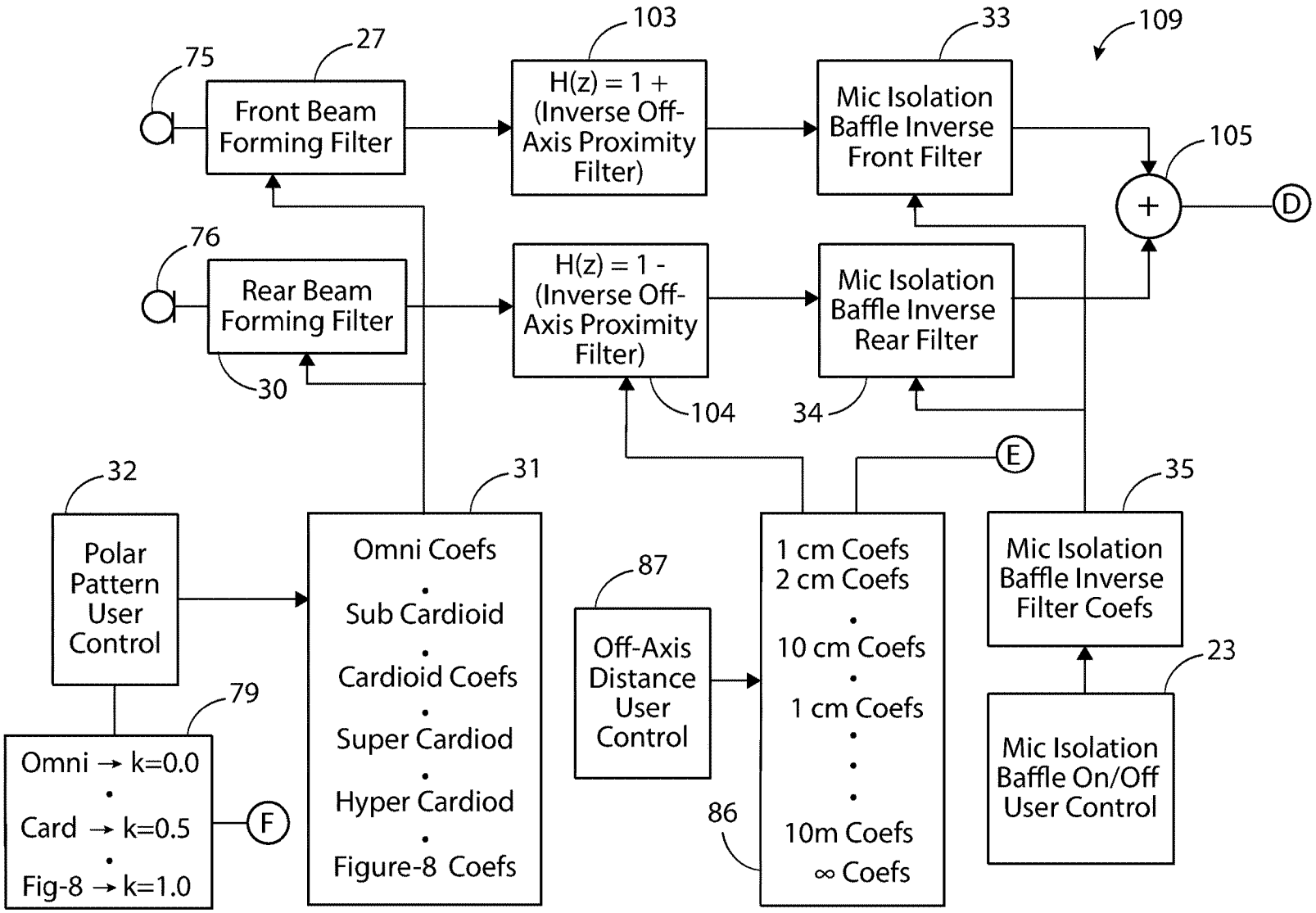
FIG. 23A illustrates a first portion of a block diagram of a microphone modeling system capable of compensating for a microphone sound-isolation baffle and proximity effect using beamforming filters.
Figure 23B:
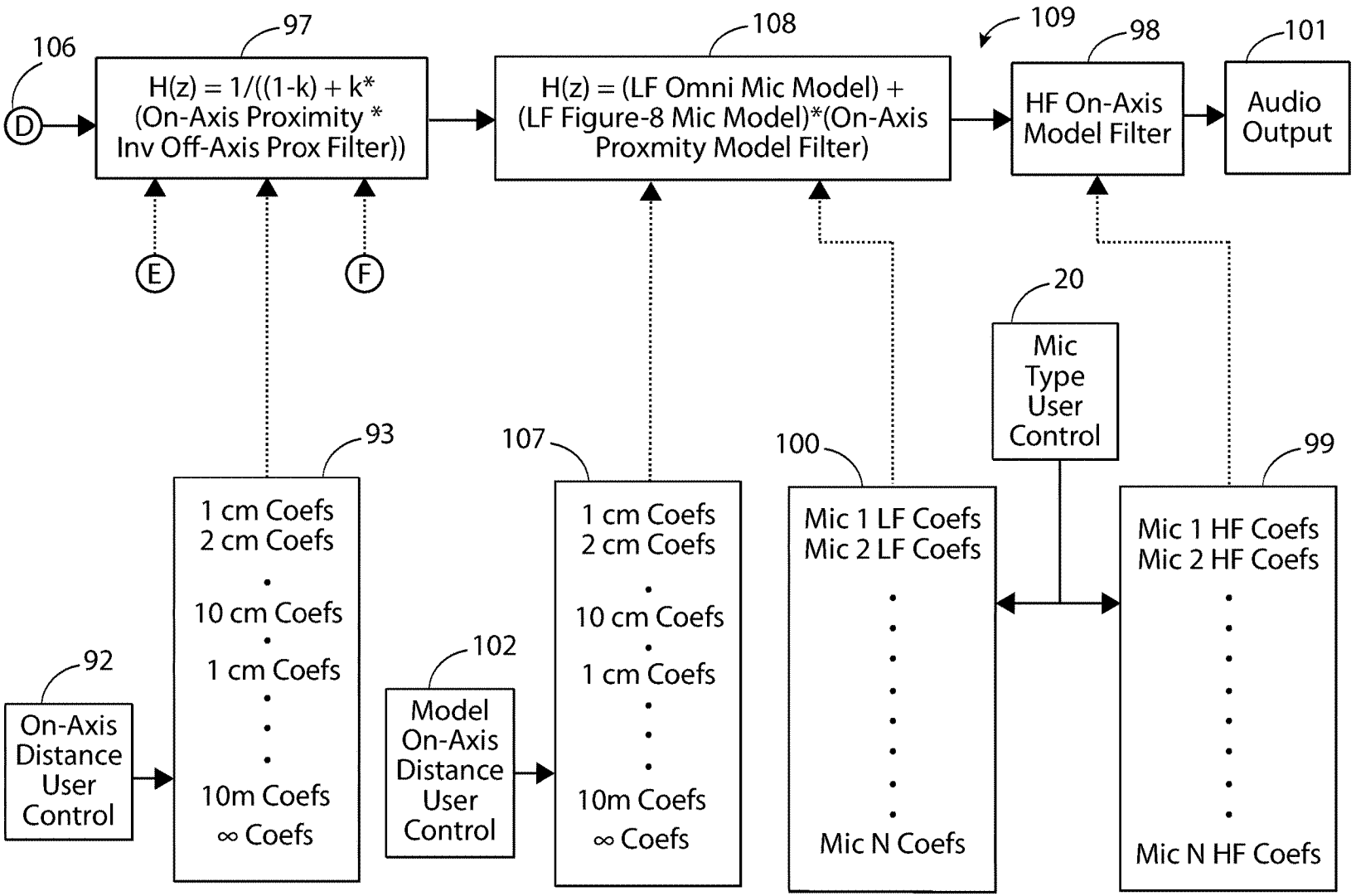
FIG. 23B illustrates a second portion of the block diagram of FIG. 23A.

The inventor recognized that because microphone sound-isolation baffles, such as the microphone sound-isolation baffle 38 of FIGS. 3-5, the microphone sound-isolation baffle 39 of FIGS. 6 and 7, the microphone sound-isolation baffle 50 of FIGS. 10-17, and the microphone sound-isolation baffle 53 in FIGS. 18 and 19 are all within a close range with their respective microphones, they can potentially change the microphone's proximity effect. For example, a microphone, in combination with the microphone sound-isolation baffle 53 may become more omnidirectional at low frequencies as the off-axis sound will tend to diffract around the microphone sound-isolation baffle 53 and enter the front of the microphone. This will reduce the proximity effect. FIGS. 22A and 22B together illustrate a block diagram of a microphone modeling system 80 capable of compensating for a microphone sound-isolation baffle and the changes in proximity effect caused by the microphone sound-isolation baffle. A letter with a circle in FIGS. 22A or 22B indicates a common signal node between the two FIGS. 22A and 22B. FIGS. 23A and 23B together illustrate a block diagram of a microphone modeling system 109 with two microphone capsules capable of compensating for a microphone sound-isolation baffle and the changes in proximity effect caused by the microphone sound-isolation baffle using beamforming filters. A letter with a circle in FIGS. 23A or 23B indicates a common signal node between the two FIGS. 23A and 23B.

Referring to FIGS. 22A and 22B, two cardioid-pattern microphone capsules placed back-to-back to form the front capsule 75 and the rear capsule 76. A first compensation filter 77 processes the output signal of the front capsule 75 and a second compensation filter 78 processes the output signal of the rear capsule 76.

The output of the first compensation filter 77 and the output of the second compensation filter 78 are summed to form an omnidirectional polar pattern signal which feeds a third compensation filter 81. The third compensation filter 81 corrects frequency response and polar pattern from omnidirectional polar pattern signal. The outputs of the first compensation filter 77 and the inverse of the output of the second compensation filter 78 are summed to form a figure-eight polar pattern signal, which feeds a fourth compensation filter 82. The fourth compensation filter 82 corrects frequency response and polar pattern from the figure-eight polar pattern signal. The resulting outputs of the compensation filters have a substantially flat on-axis response so that changing the polar pattern does not significantly affect the on-axis response.

The output of the third compensation filter 81 feeds the first microphone sound-isolation baffle inverse filter 33. The output of the fourth compensation filter 82 feeds the second microphone sound-isolation baffle inverse filter 34. Using a model of a microphone sound-isolation baffle modeled combined with the reference microphone, the first microphone sound-isolation baffle inverse filter 33 and the second microphone sound-isolation baffle inverse filter 34, removes the on-axis and off-axis frequency coloration caused by a microphone sound-isolation baffle as previously described. The microphone sound-isolation baffle inverse coefficients 35 maps the inverse frequency response coefficients of the modeled microphone sound-isolation baffle onto the first microphone sound-isolation baffle inverse filter 33 and the second microphone sound-isolation baffle inverse filter 34. The user can select whether the baffle is present or not using the microphone sound-isolation baffle on/off user control 23.

The first linear gain stage 83 with a gain of 1−k receives the signal from the output of the first microphone sound-isolation baffle inverse filter 33. The second linear gain stage 84 with a gain of k receives the signal from the output of the second microphone sound-isolation baffle inverse filter 34. The gain of the first linear gain stage 83 and the second linear gain stage 84 is determined by the value of k mapped from the polar pattern lookup table 79. The signal path for a node marked "B," designates the polar pattern lookup table 79 between FIGS. 22A and 22B. The lookup table selects the value of k based on a polar pattern user control 32. The polar pattern user control 32 can include a physical control such as a knob or switches or can be a virtual control on a graphical user interface, for example a virtual version of the polar pattern user control 32 of FIG. 9.

An inverse off-axis proximity filter 85 processes the output of the second linear gain stage 84. The inverse proximity filter is used to flatten the change in frequency response due to proximity effect. The inverse off-axis proximity filter 85 is applied to the figure-eight, or velocity component, so that the polar response is optimized at low frequencies for a particular distance.

An off-axis proximity filter lookup table 86 determines the coefficient value of the inverse off-axis proximity filter 85 based on a distance value selected by the user using an off-axis distance user control 87.

The "off-axis proximity filter" is the same as in all other cases. For the 1st order case, for example:

$$H(z)=(B0+B1\cdot z-1)/(1+A1\cdot z-1) \quad (2)$$

$$A1=\sin(kPi/4-w/2)/\sin(kPi/4+w/2) \quad (3)$$

$$A1=\sin(kPi/4-x/2)/\sin(kPi/4+w/2) \quad (4)$$

$$B0=0.5*(Gf+1.0-A1*(Gf-1.0)) \quad (5)$$

$$B1=0.5*(Gf-1.0-A1*(Gf+1.0)) \quad (6)$$

Where:
Gf=Shelf Gain;
w/2=(pi*Fc/Fs);
kPi/4=pi*0.25;
Fc=+/−3 dB cutoff frequency; and
Fs=Sample Rate.

The inverse proximity filter can be calculated in the same manner, but with the denominator and numerator inverted. For example, in equation (7):

$$H(z)=(1+A1\cdot z-1)/(B0+B1\cdot z-1) \quad (7)$$

The off-axis distance user control 87 can be a physical control, for example, a knob or push buttons, or can be a virtual control such as a knob, slider or buttons on a graphical user interface. The off-axis proximity filter lookup table 86 includes coefficient values for a filter that model the inverse square law at various distances. The inverse square law filter coefficient values are based on measured proximity effect of the microphone at various distances. For first-order gradient microphones, such as those with a figure-eight polar pattern, the inverse square law component can be approximately modeled as first-order 6 dB per octave (20 dB/decade) low pass IIR filter. More accurate results might be obtained with a second or higher order filter.

The −3 dB cutoff frequency of the first-order lowpass filter can be set to 20 Hz or the lowest audible frequency. Setting the filter any lower will unnecessarily increase subsonic energy. The lowpass filter will be mixed in with the directly signal at level that is set by the distance table. The larger the gain of the lowpass filter the more proximity effect will be modeled. At a distance setting of infinity the lowpass gain coefficient will be zero, and will increase as the distance is reduced. For example, at a distance of two meters the corresponding gain might be 1.0. Or at a distance of 10 centimeters (3.9 inches) the gain might be 4.0. The gain values for each distance can be derived empirically or using an optimization routine of measurements at various distances.

The output of the first linear gain stage 83 and the inverse off-axis proximity filter 85 are summed using a summing element 88. In a similar manner as previously described, depending on the value of k, a summed signal that results can have an omnidirectional, cardioid, figure-eight, or other polar response patterns.

If the user selects figure-eight polar pattern using the polar pattern user control 32, then the polar pattern lookup table 79 selects k=1. The first linear gain stage 83 would have a gain of 0 and the second linear gain stage 84 would have a gain of 1. The summed signal that results would have an output entirely from the inverse off-axis proximity filter 85, and therefore a predominantly figure-eight polar pattern.

If the user selects a cardioid polar pattern using the polar pattern user control 32, then the polar pattern lookup table 79 selects k=0.5. The first linear gain stage 83 would have a gain of 0.5 and the second linear gain stage 84 would have a gain of 0.5. The summed signal that results would have an output with equal contributions from the first linear gain stage 83 and the inverse off-axis proximity filter 85. The summed signal that results is a cardioid polar pattern. The summed signal 89 is labeled "A" and designates a common signal path between FIGS. 22A and 22B.

In the next stage, a proximity compensation filter 90 is applied to the summed signal 89. The proximity compensation filter 90 sums and convolves an on-axis proximity filter and an inverse off-axis proximity filter with the summed signal 89 in a proportion based on the value of k. The result is then inverted, so that the on-axis frequency response is flat at a user specified distance. The z-domain equation for the proximity compensation filter 90 is: H(z) =1/((1−k)+k*(On-Axis Proximity)*(Inverse Off-Axis Proximity)). The on-axis proximity filter 91 and the proximity compensation filter 90 is controlled by a user on-axis distance control 92 via an on-axis proximity filter lookup table 93. The on-axis proximity filter lookup table 93 maps filter coefficient values based on the distance value set by the user with the user on-axis distance control 92. In a similar manner, both the inverse off-axis proximity filter 85 of the previous stage and the inverse off-axis proximity filter in the proximity compensation filter 90 are controlled by a off-axis distance user control 87 via an off-axis proximity filter lookup table 86. The control signal path from the off-axis proximity filter lookup table 86 between FIGS. 22A and 22B is indicated by label "C." The off-axis proximity filter lookup table 86 maps filter coefficient values based on the distance value set by the user with the off-axis distance user control 87. The on-axis proximity filter lookup table 93 and the off-axis proximity filter lookup table 86 include coefficient values for filters that model the inverse square law at various distances. The inverse square law filter coefficient values are based on measured proximity effect of the microphone at various distances. The k values in the proximity compensation filter 90 are selected by the polar pattern user control 32 from the polar pattern lookup table 79. The control signal path from the polar pattern lookup table 79 to the proximity compensation filter 90 across FIGS. 22A and 22B is indicated by label "B."

In the next stage, low-frequency modeling filters are applied to the output of the proximity compensation filter 90 in order to emulate a user selected microphone model, for example a Neumann U87, an AKG C414, a Shure SM57, or a system generated response. The output of the proximity compensation filter 90 is split and processed by an omnidirectional low-frequency microphone model filter 94, and a combination of a figure-eight low-frequency microphone model filter 95 and on-axis proximity filter 91. The outcome of this stage is summed by a summing element 96.

The procedure to generate coefficients for the on-axis proximity filter 91 is similar to that of the inverse off-axis proximity filter 85. The off-axis distance user control 87 and the on-axis distance user control can be combined into a single control that can control both the on and off-axis proximity. In this case, the combined effect of inverse off-axis proximity filter and the on-axis proximity filter cancel each other out, so the proximity compensation filter 90 can be removed to reduce processing requirements. It should be noted that for FIGS. 23A and 23B, discussed later, the proximity compensation filter 97 can be similarly removed.

A high-frequency on-axis microphone model filter 98 filters the output signal from the summing element 96. The user selects the microphone to be emulated using a microphone type user control 20. The microphone type user control 20 controls the high-frequency on-axis microphone model filter 98 through a table of high-frequency on-axis microphone model coefficients 99. The microphone type user control 20 controls the omnidirectional low-frequency microphone model filter 94, and the figure-eight low-frequency microphone model filter 95 through a low-frequency microphone model coefficients lookup table 100. The audio output 101 resulting from the high-frequency on-axis microphone model filter 98 is a microphone signal adjusted for to compensate for coloration caused by the microphone sound-isolation baffle, compensated for the changes in the microphone's proximity effect caused by the microphone isolation filter, with the on-axis frequency response adjusted to emulate a user selected microphone model.

As shown in the previous section, the on-axis microphone model is split up into a low-frequency (LF) portion and a high-frequency (HF) portion. The crossover frequency between low and high frequencies should be slightly above the range that the proximity filter has a significant effect. A frequency of 1 kHz is a reasonable choice, but values from about 100 Hz to 2 kHz could be used depending on the microphone model and the proximity filter. The high-frequency on-axis microphone model filter 98 is created by flattening the response of the previously described on-axis model filter below the chosen LF/HF crossover frequency. By flattening the response at low frequencies, the high-frequency on-axis microphone model filter 98 will pass through the signal unmodified at those frequencies. This flattening can be done as a pre-processing step, so it doesn't affect the real-time operation. One way of implementing the flattening is to convert the on-axis filter coefficients into the frequency domain and then replace the high frequencies with a response that is flat in both phase and magnitude.

The low-frequency on-axis model filters are derived in a similar way, but the high frequencies are flattened and the response is decomposed into the omnidirectional low-frequency microphone model filter 94, and the figure-eight low-frequency microphone model filter 95 so that the on-axis proximity filter can be applied to the figure-eight component only. The decomposition can be performed in a number of different ways. One way is to measure the anechoic impulse response of the modeled microphone at 90° off-axis. Because a figure-eight response has a null at 90° off-axis this measurement represents the on-axis omnidirectional polar pattern portion of the microphone, because the omnidirectional polar pattern component is equal in all directions. This omnidirectional polar pattern measurement can then be subtracted from the on-axis measurement to produce an accurate estimate of the figure-eight impulse response. The omnidirectional and figure-eight impulse responses are then flattened at high frequencies and converted to FIR or IIR filter coefficients as previously described.

The on-axis proximity filter coefficients are also derived in the same way as previously described. It should be noted that these separate linear filter blocks can in general be combined into a single filter. In part they are described as separate filters for increased clarity. Also, in general the linear filter blocks can be reordered without changing the overall effect of the algorithm.

FIGS. 23A and 23B shows a system and method capable of producing polar patterns and user selectable microphone models utilizing beamforming filters, an on-axis microphone modeling filter, and proximity effect correction. A letter with a circle indicates a common signal node between FIGS. 23A and 23B. Referring to FIGS. 23A and 23B, the user can select the microphone polar pattern utilizing the polar pattern user control 32, the microphone type to be modeled utilizing the microphone type user control 20, as well as set the estimated distance the sound source is from the microphone utilizing an off-axis distance user control 87 and a user on-axis distance control 92. In this embodiment, there is user model on-axis distance control 102 acting independently with a corresponding on-axis distance proximity model filter as part of a proximity compensation filter 97. For some applications, such as live sound, the microphone must be placed very close to the source so that less gain can used, which reduces the possibility of acoustic feedback (i.e., howling). But the bass boost due to the proximity effect can be too great when the microphone is so close. With an independent on-axis proximity filter for the model a farther distance can be simulated, even though the physical microphone is much closer.

In a similar manner as described for FIGS. 22A and 22B, in FIGS. 23A and 23B, two cardioid-pattern microphone capsules placed back-to-back form the front capsule 75 and the rear capsule 76 with the first beamforming filter 27 filtering the digitized signal from the front capsule 75 and the second beamforming filter 30 filtering digitized signal from the rear capsule 76 signal. The table of polar pattern coefficients lookup table 31 adjusts coefficients of the first beamforming filter 27 and the second beamforming filter 30. The coefficients are selected from the table of polar pattern coefficients lookup table 31 based on the user's selection of the polar pattern user control 32.

A first off-axis proximity filter 103 processes the resultant signal from the first beamforming filter 27. A second off-axis proximity filter 104 processes the resultant signal from the second beamforming filter 30. The beamforming filters and the on and off-axis proximity filters can be derived in the same way as previously described. The resultant signal from the first off-axis proximity filter 103 feeds the first microphone sound-isolation baffle inverse filter 33. The resultant signal from the second off-axis proximity filter 104 feeds the second microphone sound-isolation baffle inverse filter 34. Using a model of a microphone sound-isolation baffle modeled combined with the reference microphone, the first microphone sound-isolation baffle inverse filter 33 and the second microphone sound-isolation baffle inverse filter 34, removes the on-axis and off-axis frequency coloration caused by a microphone sound-isolation baffle as previously described. The microphone sound-isolation baffle inverse coefficients 35 maps the inverse frequency response coefficients of the modeled microphone sound-isolation baffle onto the first microphone sound-isolation baffle inverse filter 33 and the second microphone sound-isolation baffle inverse filter 34. The user can select whether the baffle is present or not using the microphone sound-isolation baffle on/off user control 23.

The output of the first microphone sound-isolation baffle inverse filter 33 and the second microphone sound-isolation baffle inverse filter 34 are summed using a summing element 105.

The summed signal 106, shown as a common path across FIGS. 23A and 23B as node "D", is then processed by proximity compensation filter 97, which is functionally equivalent to proximity compensation filter 90 in FIG. 22B. The coefficients of the proximity compensation filter 97 are set based on the user on-axis distance control 92 selecting the coefficients from the on-axis proximity filter lookup table 93, the off-axis distance user control 87 selecting the coefficients from the off-axis proximity filter lookup table 86, and the polar pattern user control 32 selecting the coefficients from the polar pattern lookup table 79, in a manner similar to FIG. 22A. The common path across FIGS. 23A and 23B between the off-axis proximity filter lookup table 86 and the proximity compensation filter 97 is indicated by node "E." The common path across FIGS. 23A and 23B between from the polar pattern lookup table 79 and the proximity compensation filter 97 is indicated by node "F."

In the next stage, a first on-axis proximity LF model filter 108 processes the resultant output of the proximity compensation filter 97. The microphone type user control 20 is utilized to determine which set of coefficients is selected from the table of low-frequency microphone model coefficients lookup table 100. The user model on-axis distance control 102 determines which coefficients from the table of distance coefficients 107 are utilized by the on-axis proximity model filter within 108. As previously stated, this separate on-axis distance control allows the microphone model to have an independent distance setting. To get the maximum rejection of unwanted sound relative to the wanted sound, the desired sound source should be placed as close as possible to the sound-isolation baffle. The user model on-axis distance control 102 can be optional pre-set to a distance within the radius of the sound baffle.

The high-frequency on-axis microphone model filter 98 filters the resultant output of the first on-axis proximity LF model filter 108. The high-frequency on-axis microphone model filter 98 emulates the high-frequency on-axis frequency response characteristics of a modeled microphone selected by a user utilizing the microphone type user control 20. The microphone type user control 20 determines the coefficients from the table of high-frequency on-axis microphone model coefficients 99 utilized by the high-frequency on-axis microphone model filter 98. The audio output 101 resulting from the high-frequency on-axis microphone model filter 98 is a microphone signal adjusted for improved on and off-axis response, compensated for the effects of the microphone sound-isolation baffle, and compensated for on and off-axis proximity effect, with on-axis frequency response adjusted away from ideal to emulate a user selected microphone model.

A microphone sound-isolation baffle and a microphone sound-isolation baffle system have been described. This disclosure does not intend to limit the claimed invention to the examples, variations, and exemplary embodiments described in the specification. Those skilled in the art will recognize that variations will occur when embodying the claimed invention in specific implementations and environments. For example, the microphone sound-isolation baffle 38 of FIGS. 3-5, or the microphone sound-isolation baffle 39 of FIGS. 6 and 7 illustrate an example of a "gobo style" microphone sound-isolation baffle being removable from the microphone and settable to a predetermined distance and a predetermined rotational angle with respect to the microphone. They further illustrate two examples of a microphone that includes a first alignment portion, a microphone sound-isolation baffle that includes a second alignment portion where the first alignment portion and the second alignment portion in combination sets the microphone sound-isolation baffle to the predetermined rotational angle. The inventor envisions a wide range of combinations and variations that all fall within the scope of the inventor's microphone sound-isolation system. For example, using the teachings and variations discussed for FIGS. 3-7, other gobo style or "open-baffle style" microphone sound-isolation baffles that are removable from microphones, can be and settable to a predetermined distance and a predetermined rotational angle with respect to specific microphones.

It is possible to implement certain features described in separate embodiments in combination within a single embodiment. Similarly, it is possible to implement certain features described in single embodiments either separately or in combination in multiple embodiments. The inventor envisions these variations fall within the scope of the claimed invention. For example, the inventor envisions that the mechanical structure of the microphone sound-isolation system of FIGS. 3-5, FIGS. 6 and 7, FIGS. 10-17, or FIGS. 18 and 19, can be implemented as mechanical structures without the microphone modeling systems 10, 11, 43, 73, 80, 109 described for FIGS. 1, 2, 8, 21, 22A, 22B, 23A, and 23B, respectively, and without the graphical user interface of FIG. 9 and fall within the meaning of a microphone sound-isolation system. Similarly, the microphone sound-isolation system of FIGS. 3-5, FIGS. 6 and 7, FIGS. 10-17, or FIGS. 18 and 19, can be implemented in combination with a microphone modeling system, such as any of the microphone modeling systems 10, 11, 43, 73, 80, 109, described for FIGS. 1, 2, 8, 21, FIGS. 22A and 22B, or FIGS. 23A and 23B, respectively, with this combination falling within the scope of the meaning of a microphone sound-isolation system.

The inventor envisions that features implemented in one embodiment can be implemented in the other embodiments. Here are some examples. The microphone sound-isolation baffle detection circuit 44, and its equivalents, can be implemented in the microphone modeling system 11, 73, 80, 109 of FIG. 2, FIG. 21, FIG. 22A, and FIG. 23A and adding the detection circuitry, and its equivalents, to the reference microphones associated with these modeling systems such as the microphone 18 of FIGS. 10, 11, 12, 13, 16, and 17 or the microphone 58 of FIGS. 18 and 19. The adaptive noise cancelation scheme described for FIG. 21 can be added to the microphone modeling systems of FIGS. 1, 2, 6, 22A and 22B, and 23A and 23B. A microphone shock mount 52 was discussed in FIGS. 16 and 17. The shock mount of FIGS. 16 and 17 can be added to other embodiments such as the embodiment of FIGS. 3-5, FIGS. 6 and 7, and FIGS. 18 and 19

Figure 24:
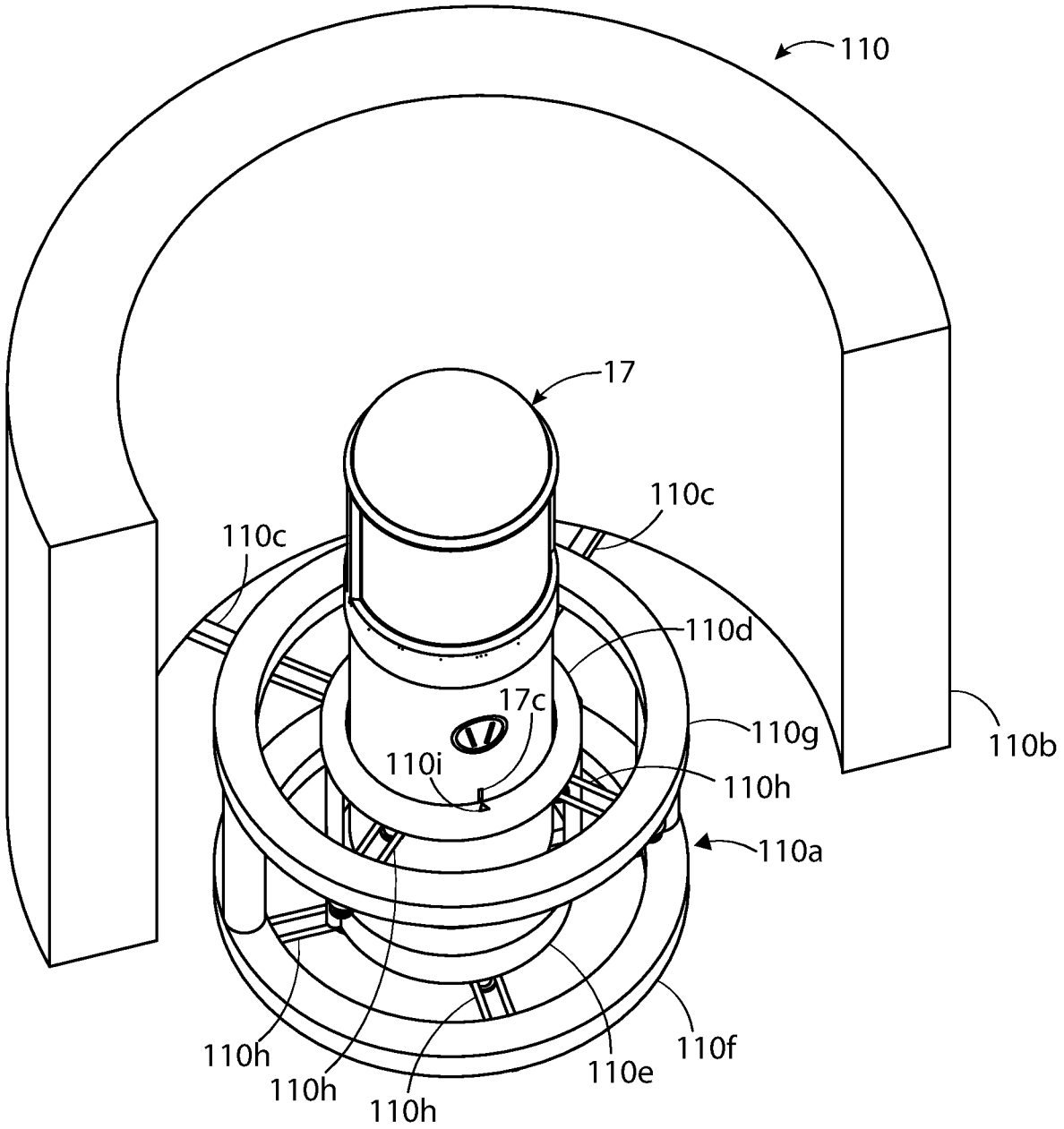
FIG. 24 illustrates an example of a microphone sound-isolation baffle and a microphone, similar to FIG. 3, except with shock mounting, in front and top perspective view.
Figure 25:
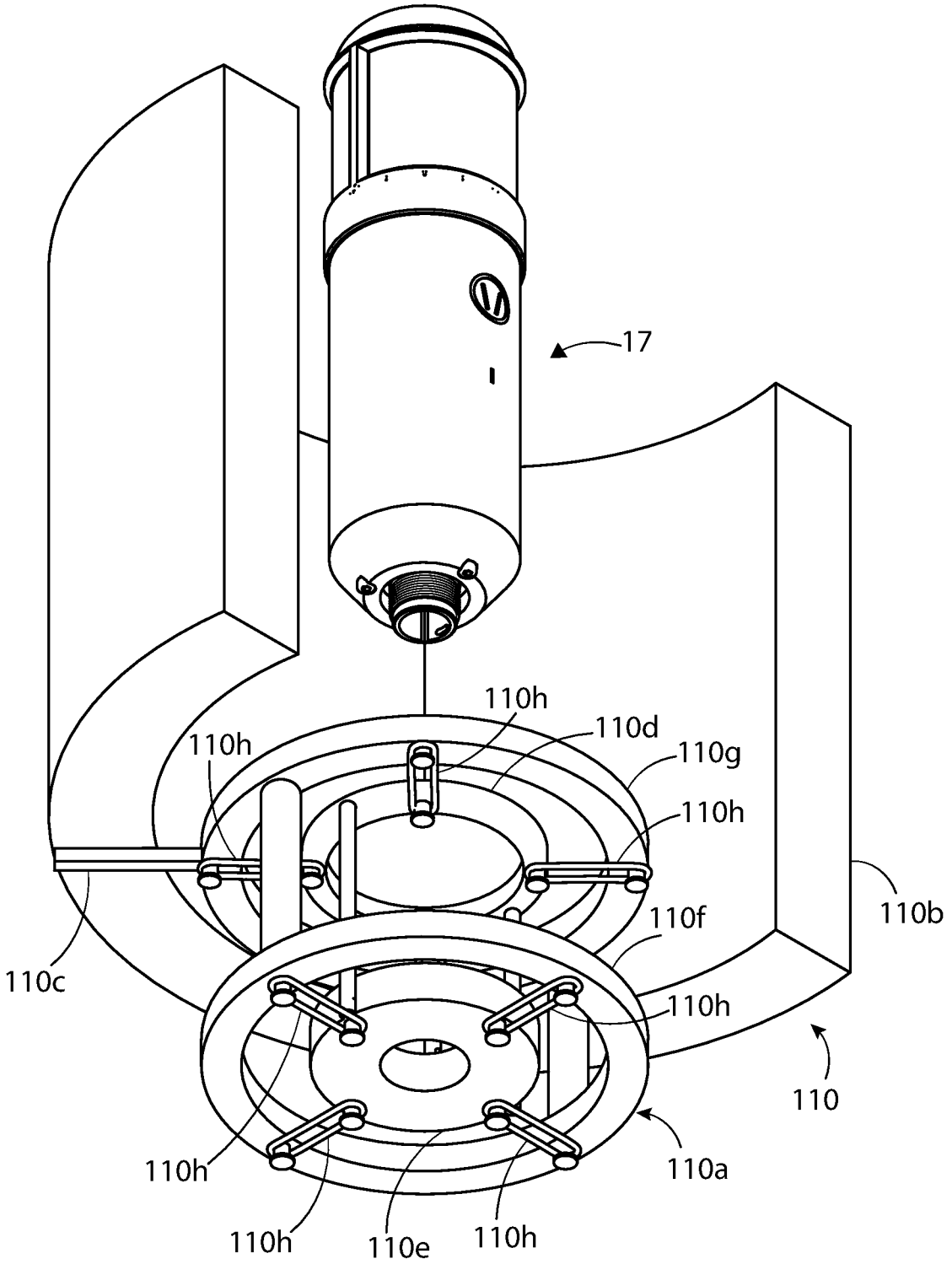
FIG. 25 illustrates the microphone sound-isolation baffle and microphone of FIG. 24 in front and bottom perspective view.

FIGS. 24 and 25 demonstrate an additional example of how the embodiment of FIGS. 3-5, FIGS. 6 and 7 can incorporate a shock mount. Referring to FIGS. 24 and 25, microphone 17 is mounted within the microphone mounting structure 110*a* of the microphone sound-isolation baffle 110. The microphone mounting structure 110*a* can be mounted to the acoustic baffle body 110*b* by arms 110*c* in a similar manner as shown and described for FIGS. 3-5 and 6. For example, the arms can be mounted to an internal or external structure within the acoustic baffle body such as rigid or semi-rigid frame. The microphone mounting structure can include an inner rings 110*d*, 110*e* that engage the microphone 17 and outer rings 110*f*, 110*g* that are secured to the arms 110*c* and acoustic baffle body 110*b*. The inner ring can be coupled to the outer ring by elastic members 110*h* that acoustically isolate the inner rings 110*d*, 110*e* from the outer rings 110*f*, 110*g*. In FIG. 24, the microphone 17 is rotationally aligned to the microphone sound-isolation baffle 110 to a predetermined rotational position using a first indicia 17*c* and a second indicia 110*i*. The microphone 17 can be aligned and fixed to a predetermined rotational position with respect to the microphone sound-isolation baffle using projected portions, such as first projected portion 17*a* and the second projected portion 38*a* in FIG. 3.

FIG. 18 demonstrates how auxiliary microphones 54, 55 could be implemented by adapting the microphone sound-isolation baffle of FIGS. 10-17. In FIG. 18 an auxiliary microphone positioned external to the microphone sound-isolation baffle with respect to the reference microphone. FIGS. 18 and 19 demonstrate how the microphone 18 of FIGS. 10-17 can be adapted into microphone 58 to either accept and pass through the analog signals from the auxiliary microphones 54, 55 or digitally process these signals within the microphone 58 and pass through a resultant digital signal. Using this teaching, the microphone sound-isolation baffles of FIGS. 3-7, and other "gobo style" microphone sound-isolation baffles can be adapted to accept auxiliary microphones by mounting the auxiliary microphones 54, 55 of FIG. 18 on the outward facing surface (i.e., the surface facing away from the microphone) of the acoustic baffle body 38*d*.

FIG. 19 demonstrates how auxiliary microphones 54, 55 can be positioned on the microphone body 58*b* of the microphone 58. Using this teaching, the microphone 17 of FIGS. 3-7 could be adapted to mount auxiliary microphones 54, 55 positioned below the microphone sound-isolation baffle 38.

While the examples, exemplary embodiments, and variations are helpful to those skilled in the art in understanding the claimed invention, it should be understood that, the claimed invention is defined solely by the claims and their equivalents.

The claims are not to be interpreted as including means-plus-function limitations unless a claim explicitly evokes the means-plus-function clause of 35 USC § 112(f) by using the phrase "means for" followed by a verb in gerund form.

"Optional" or "optionally" is used throughout this disclosure to describe features or structures that are optional. Not using the word optional or optionally to describe a feature or structure does not imply that the feature or structure is essential, necessary, or not optional. Discussing advantages of one feature over another, or one implementation or another conceived by the inventor, does not imply that that feature or implementation is essential. Using the word "or," as used in this disclosure is to be interpreted as the Boolean meaning of the word "or" (i.e., an inclusive or) For example, the phrase "A or B" can mean: A without B, B without A, A with B. For example, if one were to say, "I will wear a waterproof jacket if it snows or rains," the meaning is that the person saying the phrase intends to wear a waterproof jacket if it rains alone, if it snows alone, if it rains and snows in combination.

What is claimed is:

1. A system for modeling a target microphone from a reference microphone and compensating for a sonic contribution from a microphone sound-isolation baffle, comprising:

a processor configured to receive a microphone capsule signal from a microphone capsule within the reference microphone and act on the microphone capsule signal by emulating a user selected target microphone on-axis microphone model frequency response and compensating for the sonic contribution of the microphone sound-isolation baffle based on a modeled response of the microphone sound-isolation baffle.

2. The system of claim 1, further comprising:

a microphone sound-isolation baffle detection circuit; and the processor configured to reduce the sonic contribution of the microphone sound-isolation baffle as a result of the microphone sound-isolation baffle detection circuit detecting a presence of the microphone sound-isolation baffle in combination with the reference microphone.

3. The system of claim 1, further comprising:

the reference microphone; and the microphone sound-isolation baffle, the microphone sound-isolation baffle being removable from the reference microphone and settable to a predetermined distance and a predetermined rotational angle with respect to the reference microphone.

4. The system of claim 3, further including:

an auxiliary microphone positioned external to the microphone sound-isolation baffle with respect to the reference microphone; and the processor receiving and acting on an auxiliary microphone signal from the auxiliary microphone, adaptively cancels portions of the auxiliary microphone signal from the microphone capsule signal that is common to the microphone capsule signal.

5. The system of claim 1, further comprising:

an auxiliary microphone positioned external to the microphone sound-isolation baffle with respect to the reference microphone; and the processor receiving and acting on an auxiliary microphone signal, adaptively cancels portions of the auxiliary microphone signal from the microphone capsule signal that is common to the microphone capsule signal.

6. The system of claim 1, further comprising:

the reference microphone;

the microphone sound-isolation baffle; and the microphone sound-isolation baffle being removable from the reference microphone and fixable to a predetermined distance and a predetermined rotational angle with respect to the reference microphone.

7. The system of claim 1, wherein:

the processor is further configured to compensate for the sonic contribution of the microphone sound-isolation baffle based on a modeled on-axis frequency response and with increased off-axis sound rejection.

8. The system of claim 7, further comprising:

the reference microphone;

the microphone sound-isolation baffle; and the microphone sound-isolation baffle being removable from the reference microphone and settable to a predetermined distance and a predetermined rotational angle with respect to the reference microphone.

9. A microphone sound-isolation system, comprising:

a reference microphone;

a microphone sound-isolation baffle being removable from the reference microphone and settable to a predetermined distance and a predetermined rotational angle with respect to the reference microphone; and the reference microphone includes a processor configured to receive a microphone capsule signal from a microphone capsule within the reference microphone and act on the microphone capsule signal by emulating a user selected target microphone on-axis microphone model frequency response and reducing a sonic contribution of the microphone sound-isolation baffle based on a modeled response of the microphone sound-isolation baffle.

10. A system for modeling a target microphone from a reference microphone and compensating for a sonic contribution from a microphone sound-isolation baffle, comprising:

a non-transitory computer readable medium including instructions stored therein that when executed by a processor cause the processor to receive a microphone capsule signal from a microphone capsule within the reference microphone and act on the microphone capsule signal by emulating a user selected target microphone on-axis microphone model frequency response and compensating for the sonic contribution of the microphone sound-isolation baffle based on a modeled response of the microphone sound-isolation baffle.

11. The system of claim 10, further comprising:

a microphone sound-isolation baffle detection circuit; and the processor configured to reduce the sonic contribution of the microphone sound-isolation baffle as a result of the microphone sound-isolation baffle detection circuit detecting a presence of the microphone sound-isolation baffle in combination with the reference microphone.

12. The system of claim 10, further comprising:

the reference microphone; and the microphone sound-isolation baffle, the microphone sound-isolation baffle being removable from the reference microphone and settable to a predetermined distance and a predetermined rotational angle with respect to the reference microphone.

13. The system of claim 12, further including:

an auxiliary microphone positioned external to the microphone sound-isolation baffle with respect to the reference microphone; and the processor receiving and acting on an auxiliary microphone signal from the auxiliary microphone, adaptively cancels portions of the auxiliary microphone signal from the microphone capsule signal that is common to the microphone capsule signal.

14. The system of claim 10, further comprising:

an auxiliary microphone positioned external to the microphone sound-isolation baffle with respect to the reference microphone; and the processor receiving and acting on an auxiliary microphone signal, adaptively cancels portions of the auxiliary microphone signal from the microphone capsule signal that is common to the microphone capsule signal.

15. The system of claim 10, further comprising:

the reference microphone;

the microphone sound-isolation baffle; and the microphone sound-isolation baffle being removable from the reference microphone and fixable to a predetermined distance and a predetermined rotational angle with respect to the reference microphone.

16. The system of claim 10, wherein:

the processor is further configured to compensate for the sonic contribution of the microphone sound-isolation baffle based on a modeled on-axis frequency response and with increased off-axis sound rejection.

17. The system of claim 16, further comprising:

the reference microphone;

the microphone sound-isolation baffle; and the microphone sound-isolation baffle being removable from the reference microphone and settable to a predetermined distance and a predetermined rotational angle with respect to the reference microphone.

* * * * *